US011685025B2

(12) United States Patent
Dimattia, Jr. et al.

(10) Patent No.: US 11,685,025 B2
(45) Date of Patent: Jun. 27, 2023

(54) DOOR STOP INSTALLATION TOOL AND METHOD OF USING SAME

(71) Applicant: Marshen Tools, LLC, New Bern, NC (US)

(72) Inventors: Donald Dimattia, Jr., New Bern, NC (US); Frank Marshen, New Bern, NC (US)

(73) Assignee: Marshen Tools, LLC, New Bern, NC (US)

( * ) Notice: Subject to any disclaimer, the term of this patent is extended or adjusted under 35 U.S.C. 154(b) by 385 days.

(21) Appl. No.: 16/993,963

(22) Filed: Aug. 14, 2020

(65) Prior Publication Data

US 2022/0048166 A1 Feb. 17, 2022

(51) Int. Cl.

| | |
|---|---|
| ***B25B 21/00*** | (2006.01) |
| ***E05F 5/00*** | (2017.01) |
| ***B25B 21/02*** | (2006.01) |

(52) U.S. Cl.

CPC ..... *B25B 21/002* (2013.01); *B25B 21/007* (2013.01); *B25B 21/02* (2013.01); *E05F 5/00* (2013.01)

(58) Field of Classification Search

CPC ..... B25B 13/5091; B25B 13/06; B25B 13/48
See application file for complete search history.

(56) References Cited

U.S. PATENT DOCUMENTS

| | | | | |
|---|---|---|---|---|
| 2,750,828 | A * | 6/1956 | Wendling | B25B 23/12 285/317 |
| 3,151,512 | A * | 10/1964 | Charczenko | B25B 13/5091 81/125 |
| 3,228,269 | A * | 1/1966 | Heyer | B25B 13/48 81/124.2 |
| 5,335,569 | A * | 8/1994 | Rowley | B25B 13/5091 81/125 |
| 5,425,290 | A * | 6/1995 | Fought | B25B 13/48 81/125 |
| 5,943,922 | A * | 8/1999 | Rolfe | B25B 13/5091 81/124.2 |
| 6,711,974 | B1 * | 3/2004 | Lin | B25B 13/5091 81/125 |
| 6,715,384 | B1 * | 4/2004 | Kozak | B25B 13/06 81/176.15 |
| 9,221,155 | B1 * | 12/2015 | Cantion | B25B 13/06 |
| 9,511,482 | B2 * | 12/2016 | Stonefield | B25B 13/5091 |
| 2014/0102261 | A1 * | 4/2014 | Willicombe | B25B 13/06 29/402.01 |

* cited by examiner

*Primary Examiner* — Jason L Vaughan
(74) *Attorney, Agent, or Firm* — Ward and Smith, P.A.; Ryan K. Simmons

(57) ABSTRACT

A door stop installation device. The door stop installation device may include a main body portion; a door stop receiving portion integrated into the main body portion; an extension portion extending from a proximal end of the main body portion; an opening in a distal end of the main body portion; and wherein, the door stop receiving portion may be configured to receive at least one type of a door stop.

12 Claims, 44 Drawing Sheets

DOOR STOP INSTALLATION TOOL AND METHOD OF USING SAME

TECHNICAL FIELD

The presently disclosed subject matter relates generally to door stop installation tool and methods, and more particularly to a door stop installation tool and method of using same.

BACKGROUND

Currently, to install a door stop (or doorstop or door stopper) an installer may push by hand the screw portion of the door stop into the baseboard or other surface and then turn the door stop manually by hand or using a wrench. It can be difficult to hold the door stop normal to the baseboard while at the same time attempting to screw it in manually by hand or with a tool, and even more difficult when working in tight spaces.

SUMMARY

In one embodiment a door stop installation device is provided. The door stop installation device may include a main body portion; a door stop receiving portion integrated into the main body portion; an extension portion extending from a proximal end of the main body portion; an opening in a distal end of the main body portion; and wherein, the door stop receiving portion may be configured to receive at least one type of a door stop. The door stop receiving portion may include a cavity formed in the main body portion. A proximal end of the extension portion may be configured to engage with a driver device. The extension portion may include a hex extension. The main body portion and extension portion may be configured together such that as the extension portion rotates the main body portion rotates. The door stop receiving portion of the main body portion may be configured such that as the main body portion rotates a door stop received in the door stop receiving portion rotates. A distal end of the extension portion may extend into the door stop receiving portion. The distal end of the extension portion extending into the door stop receiving portion may be any of a slotted, cross-head (Phillips), torx, or hex style head. The main body portion may further include one or magnets at the distal end of the main body portion. The main body portion may include a slot formed in a side thereof for inserting a door stop into the door stop receiving portion. The door stop receiving portion may be configured such that when a door stop is received therein a portion of the door stop extends through the opening and beyond the distal end of the main body portion.

In another embodiment a method of installing a door stop is provided. The method may include providing a door stop installation device; installing the door stop installation device into a driver device; installing the door stop into the door stop receiving portion of the installing the door stop into the designated structure; and disengaging the door stop installation device from the installed door stop.

BRIEF DESCRIPTION OF THE DRAWINGS

Figure 1:
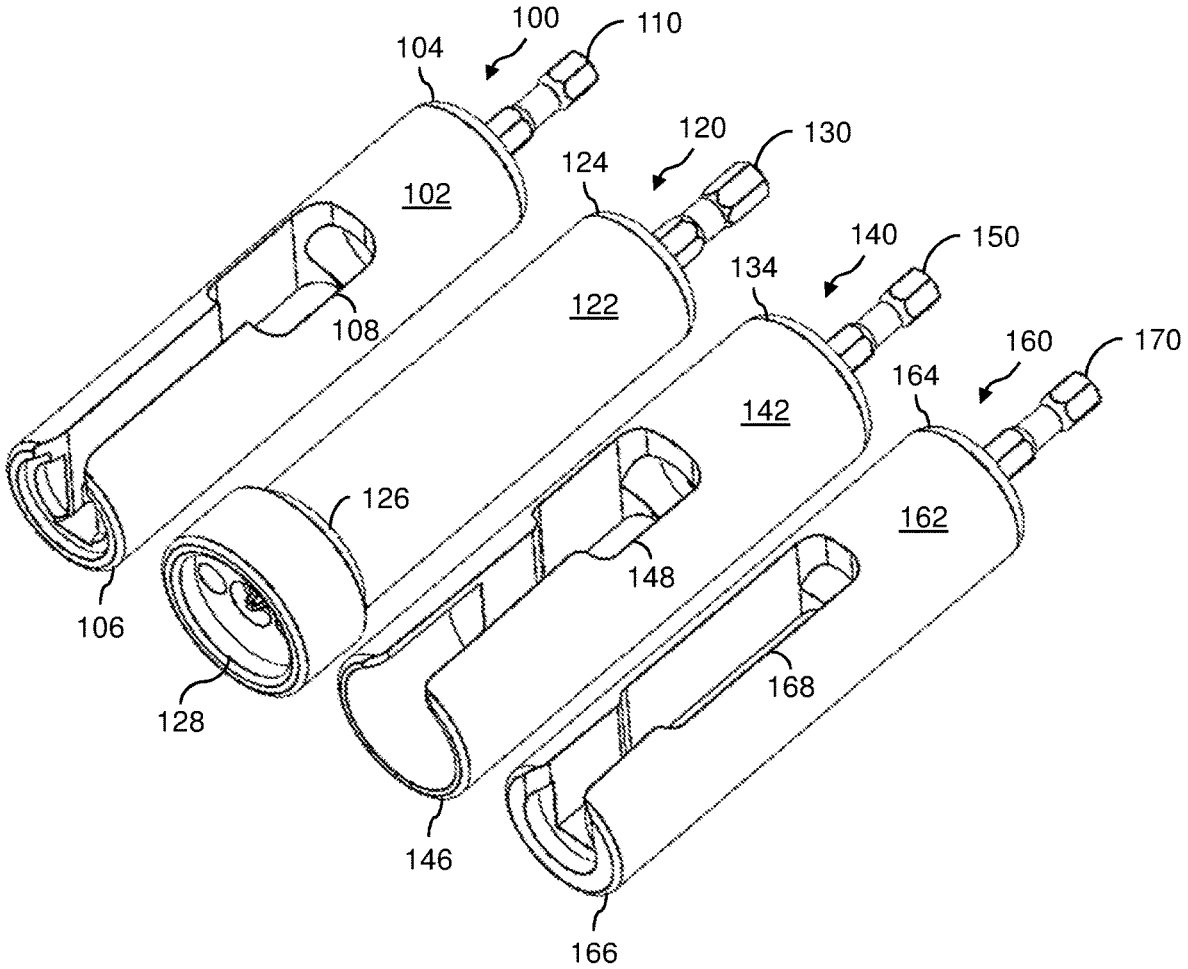
Figure 2:
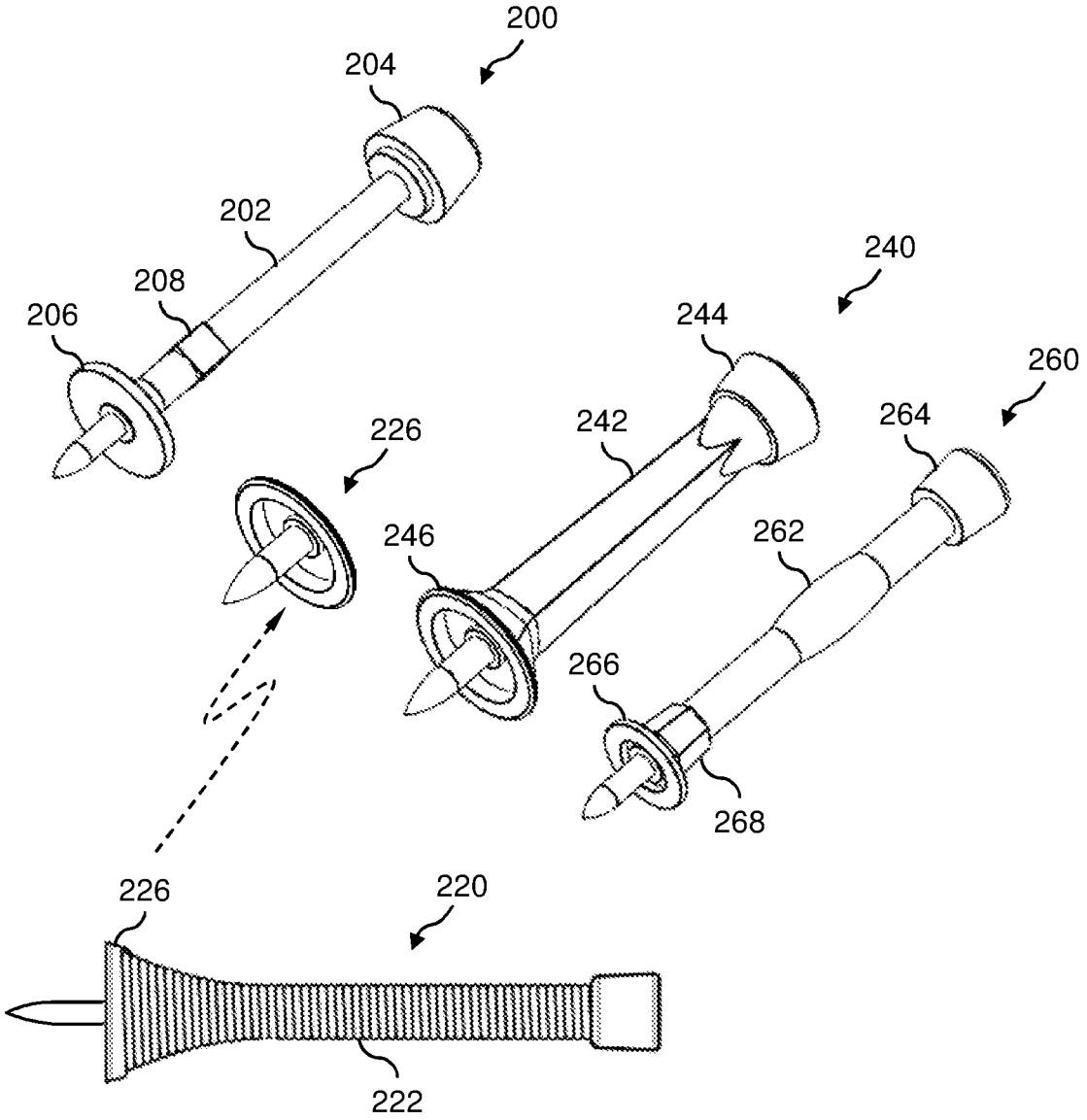
Figure 3:
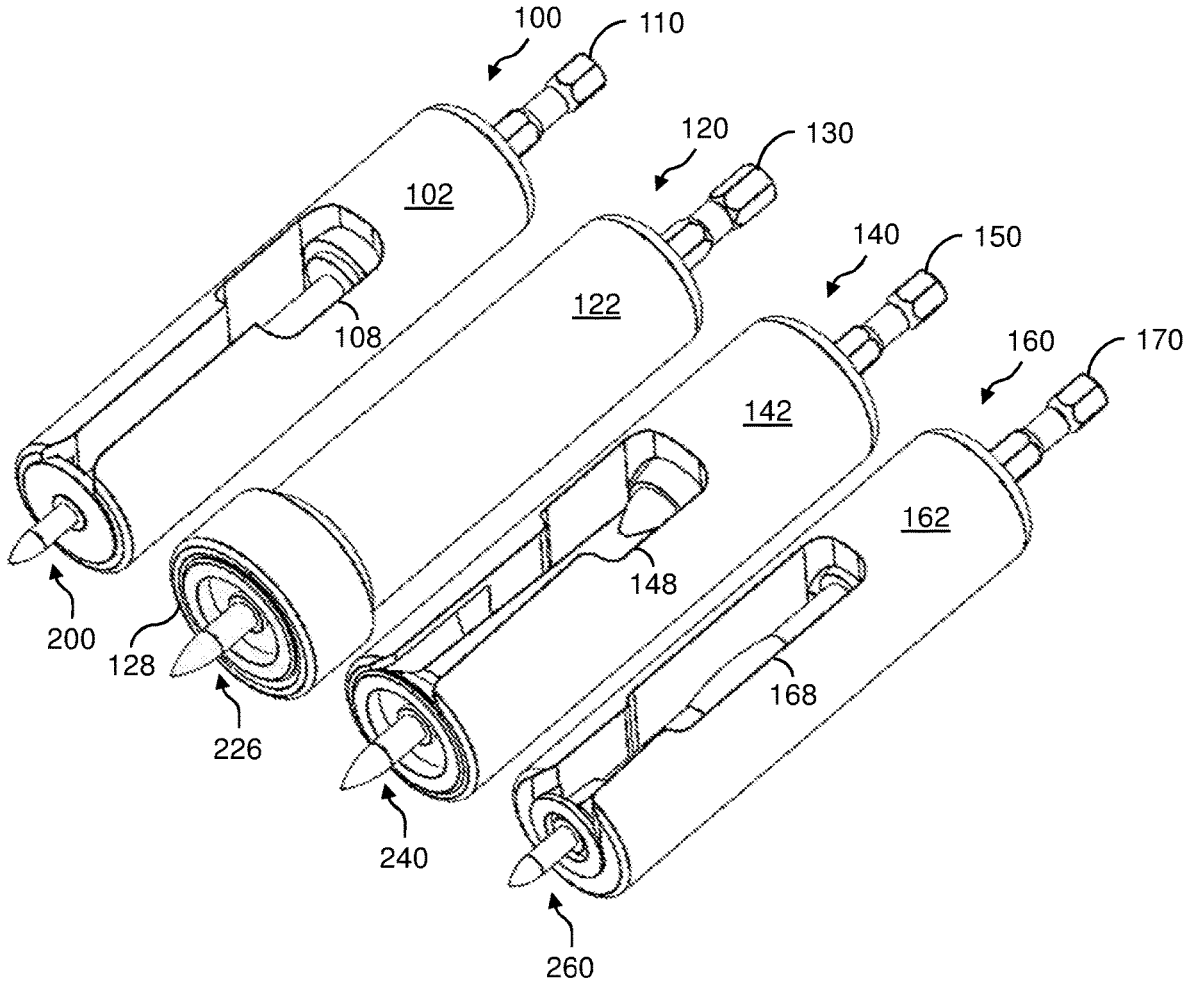
Figure 4:
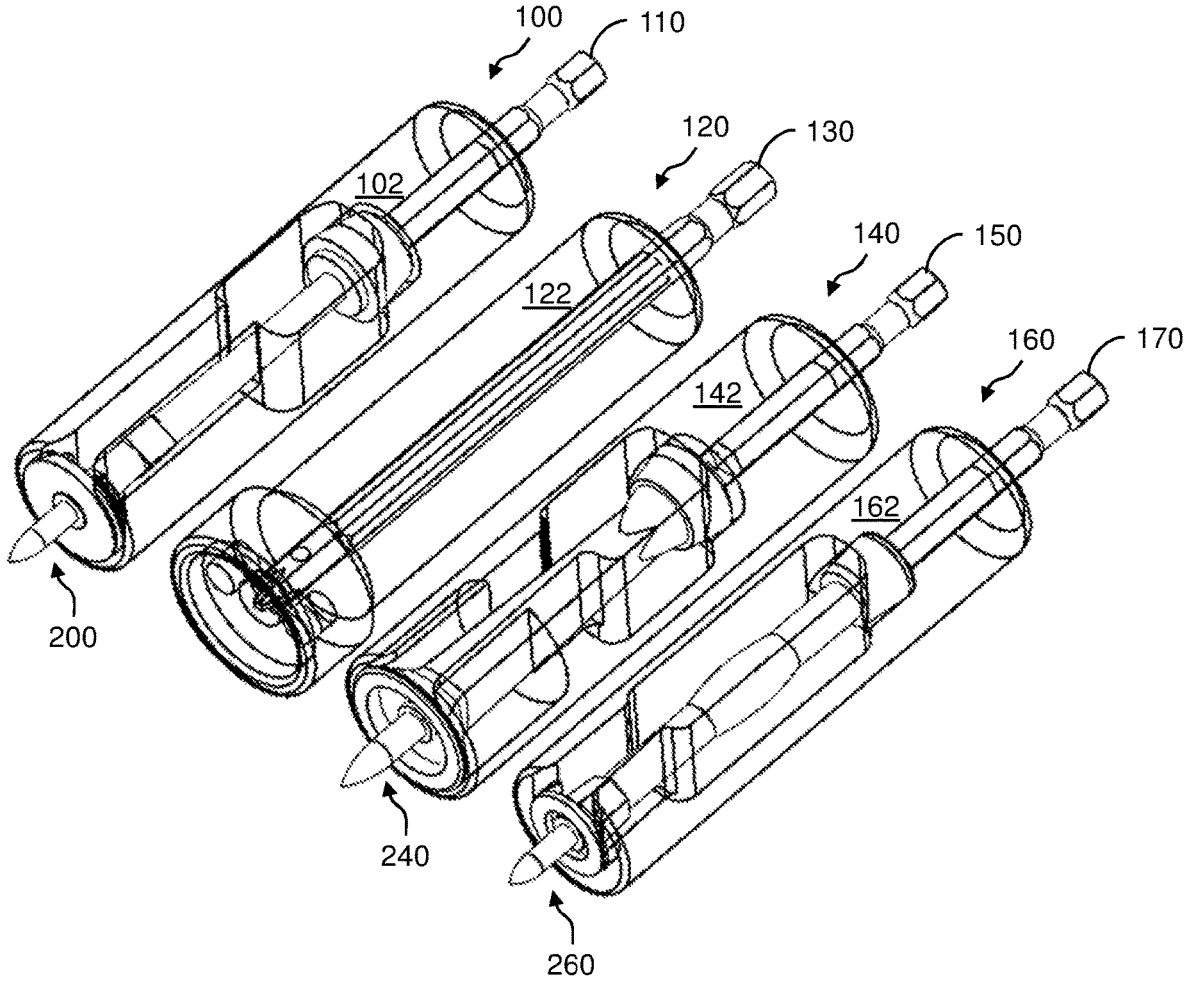
Figure 5:
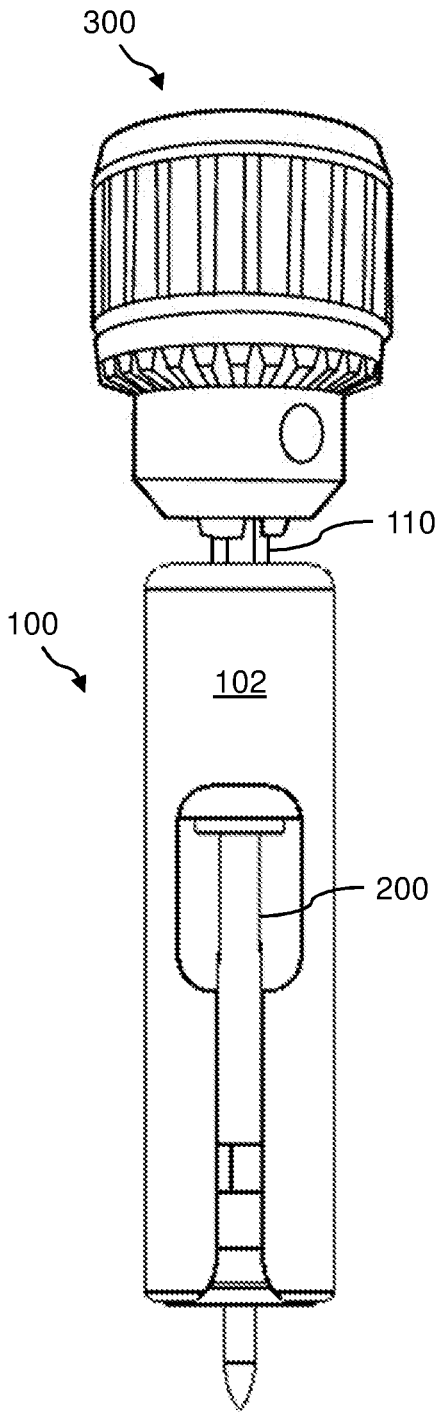
Figure 6:
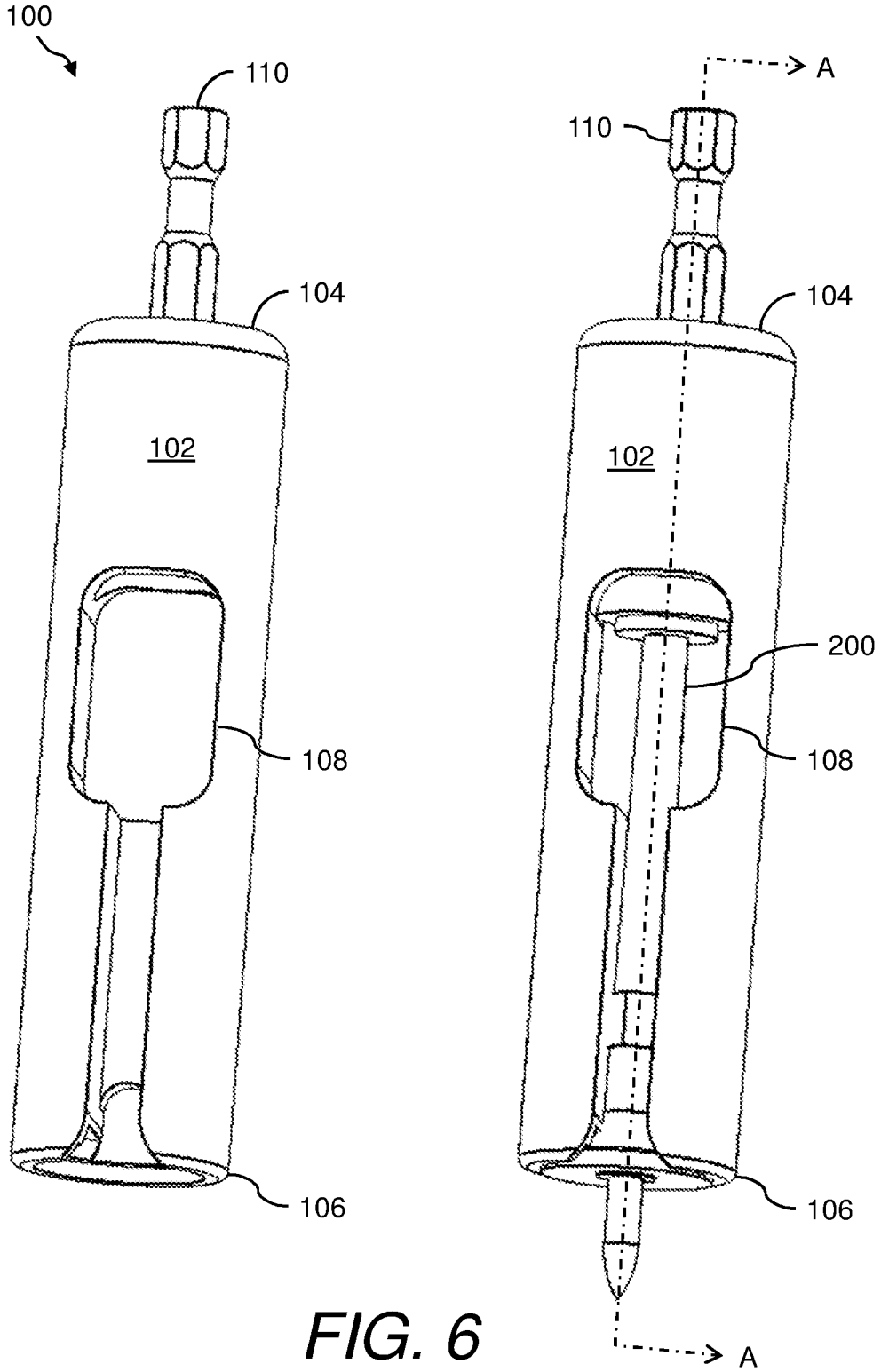
Figure 7:
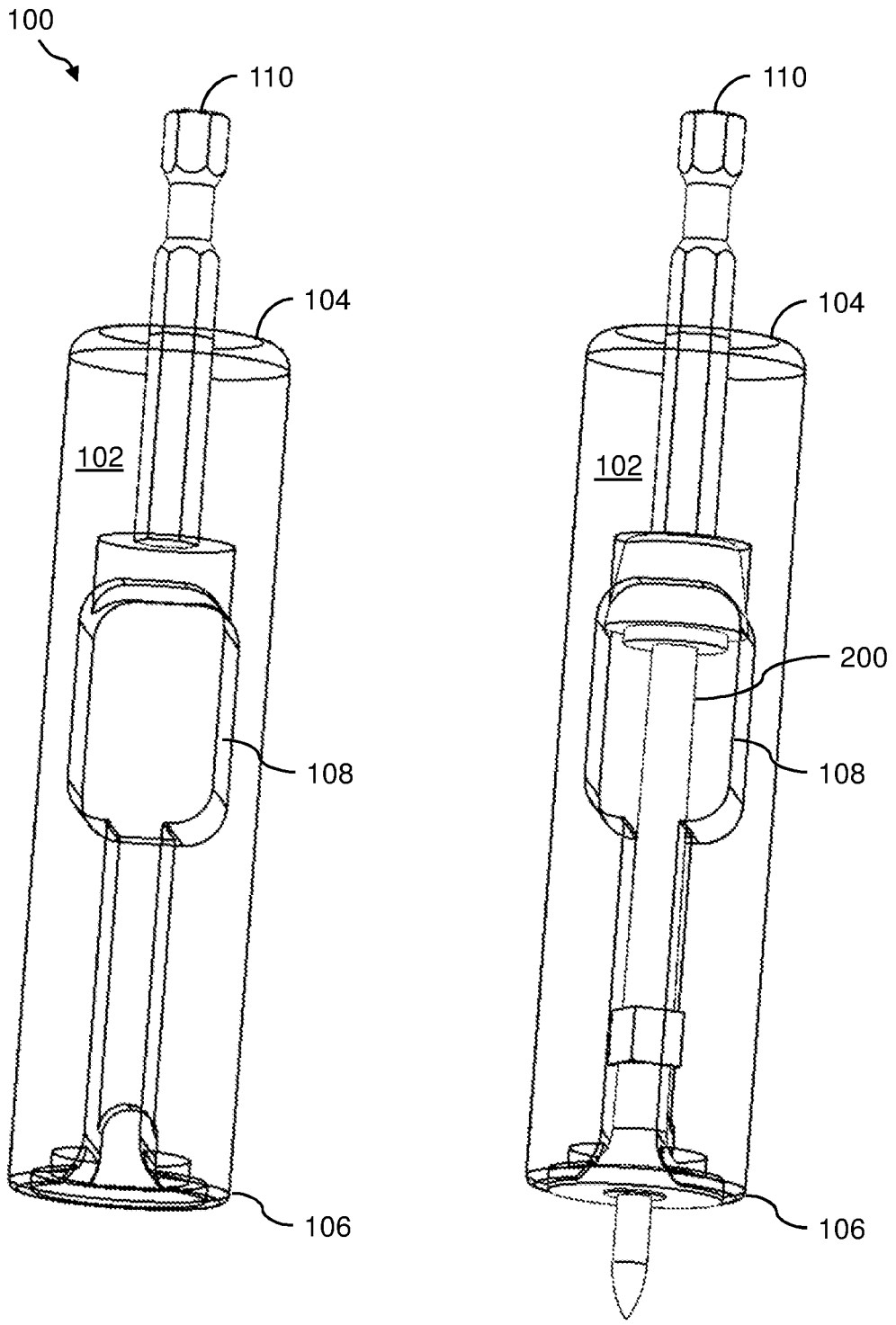
Figure 8:
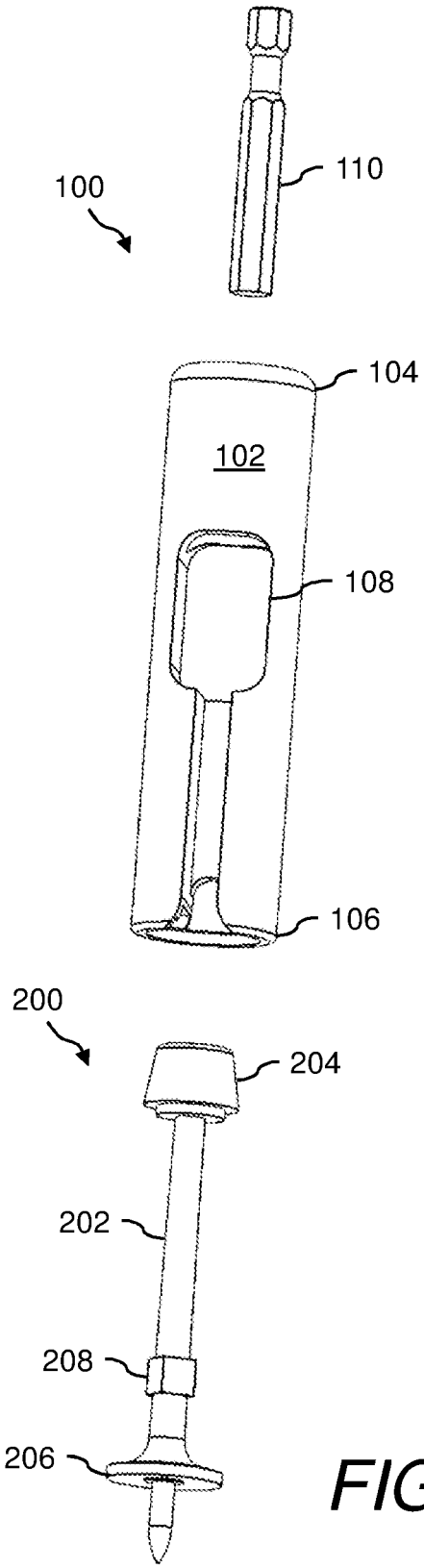
Figure 9:
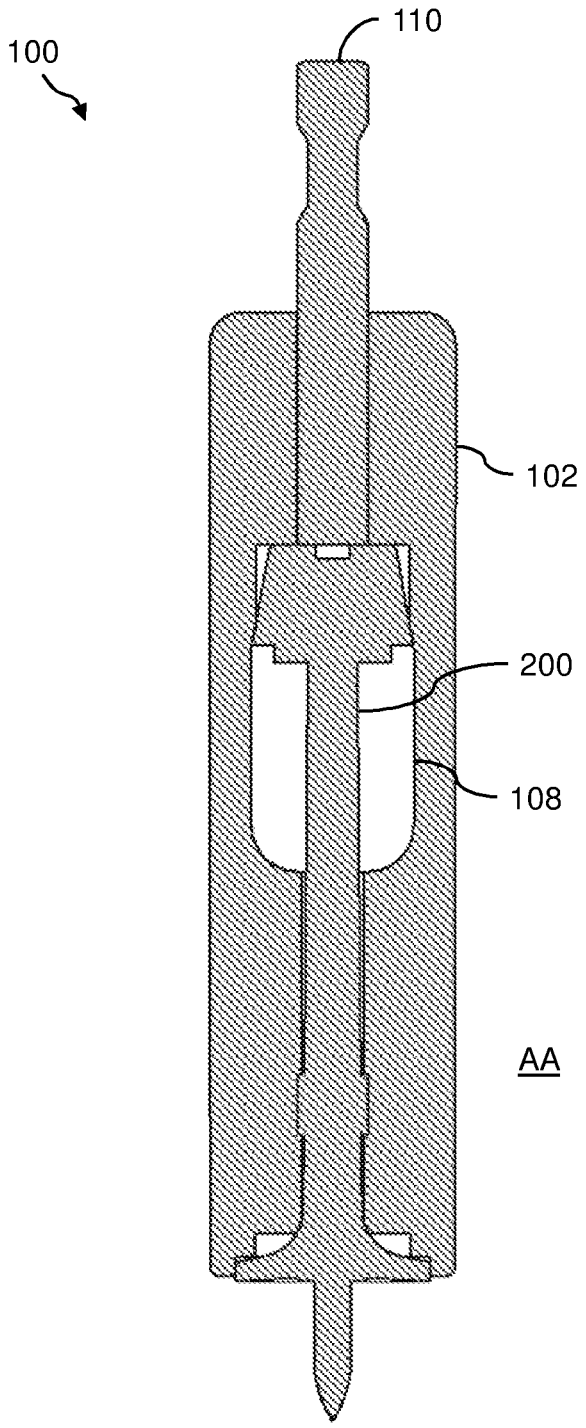
Figure 10:
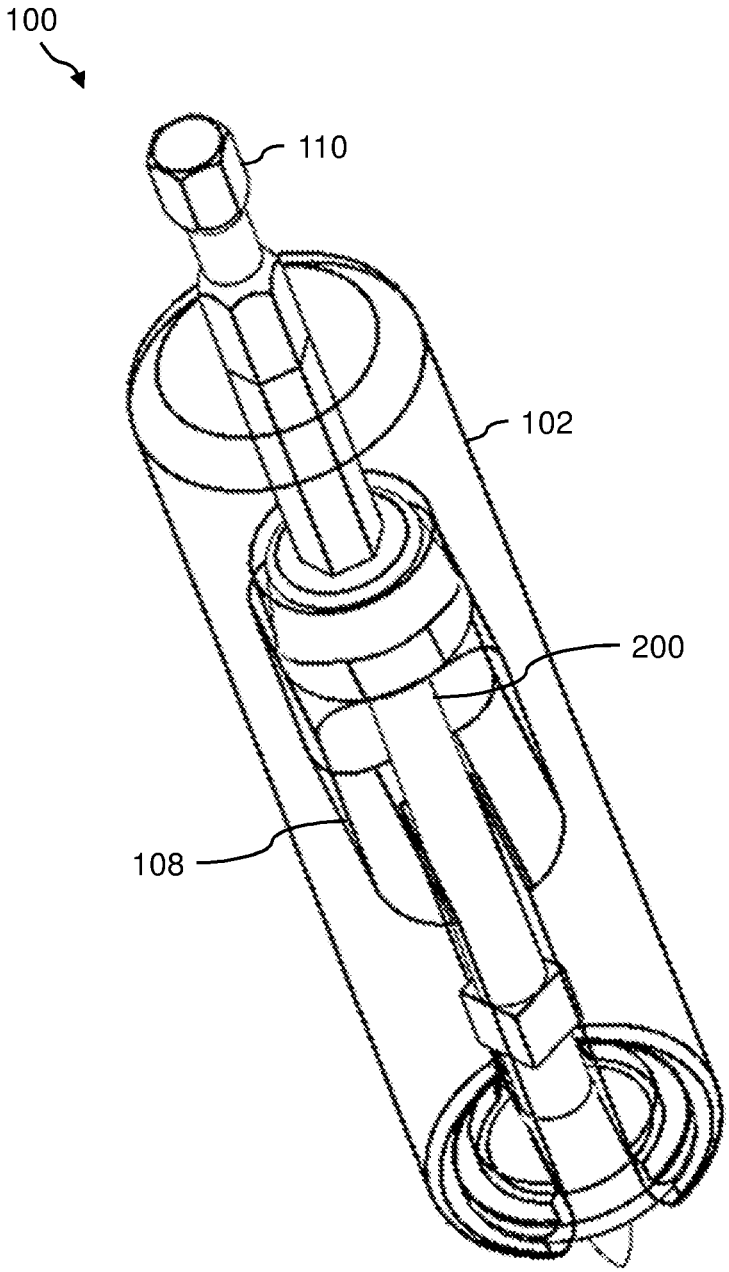
Figure 11:
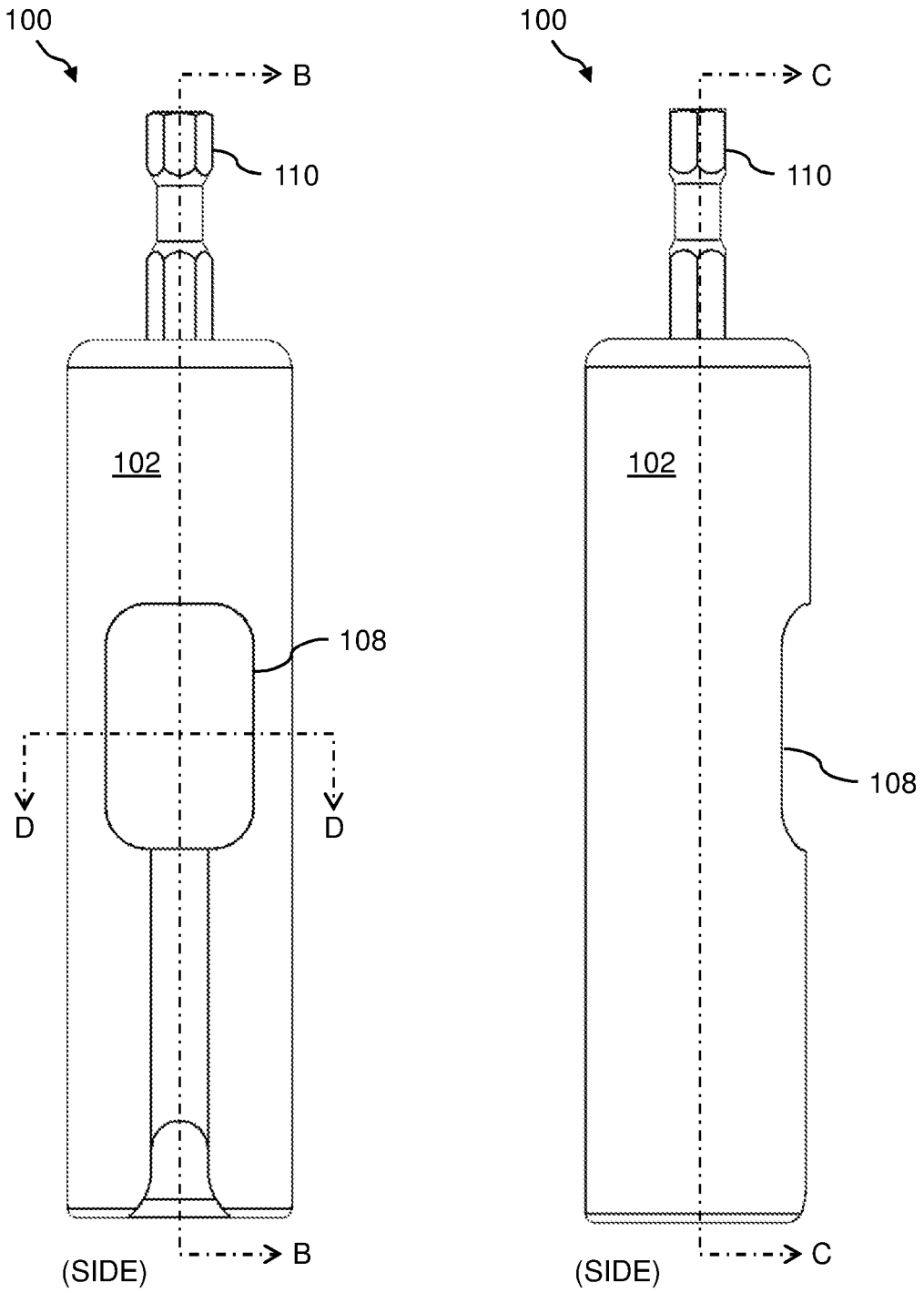
Figure 12:
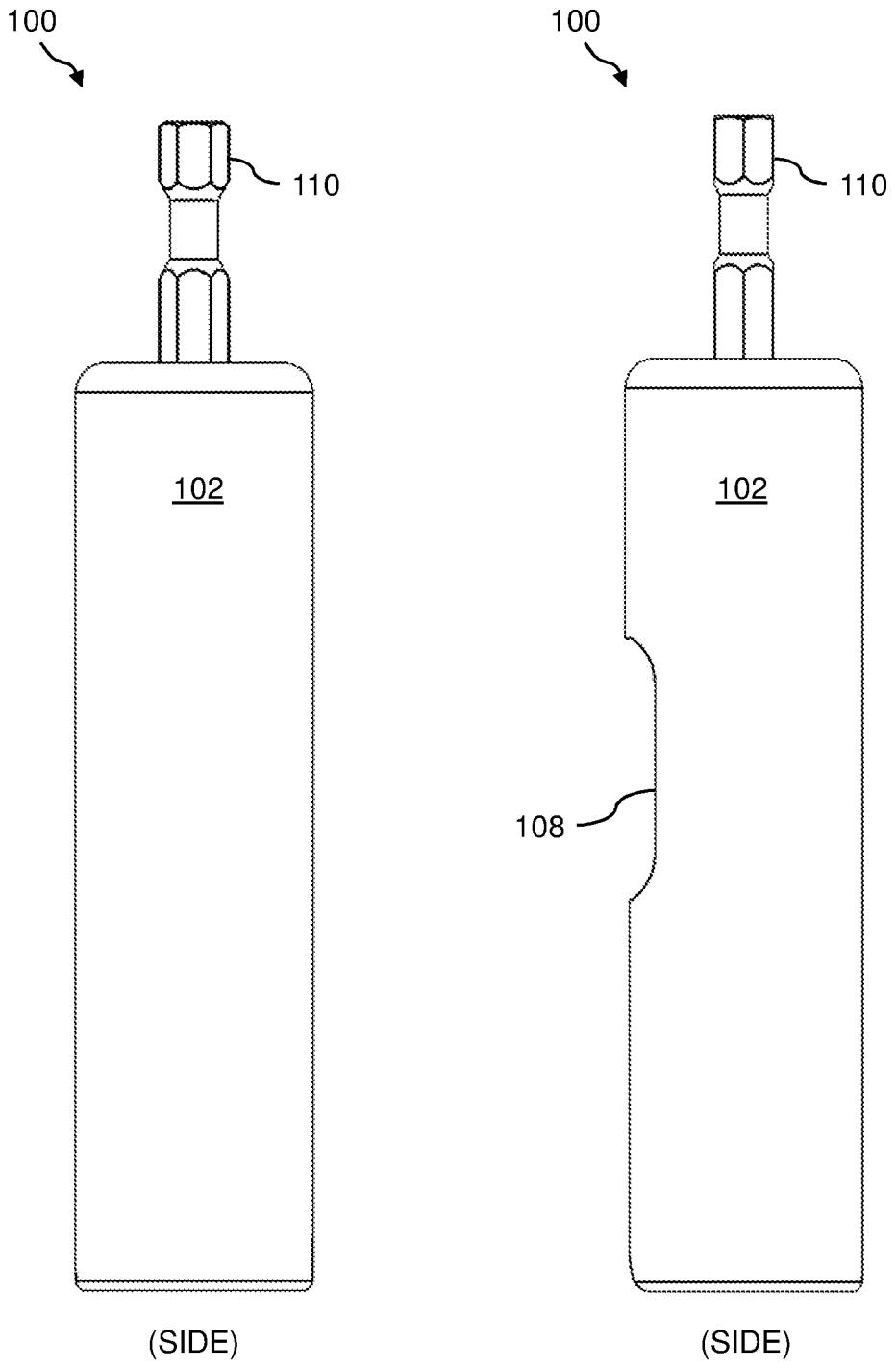
Figure 13:
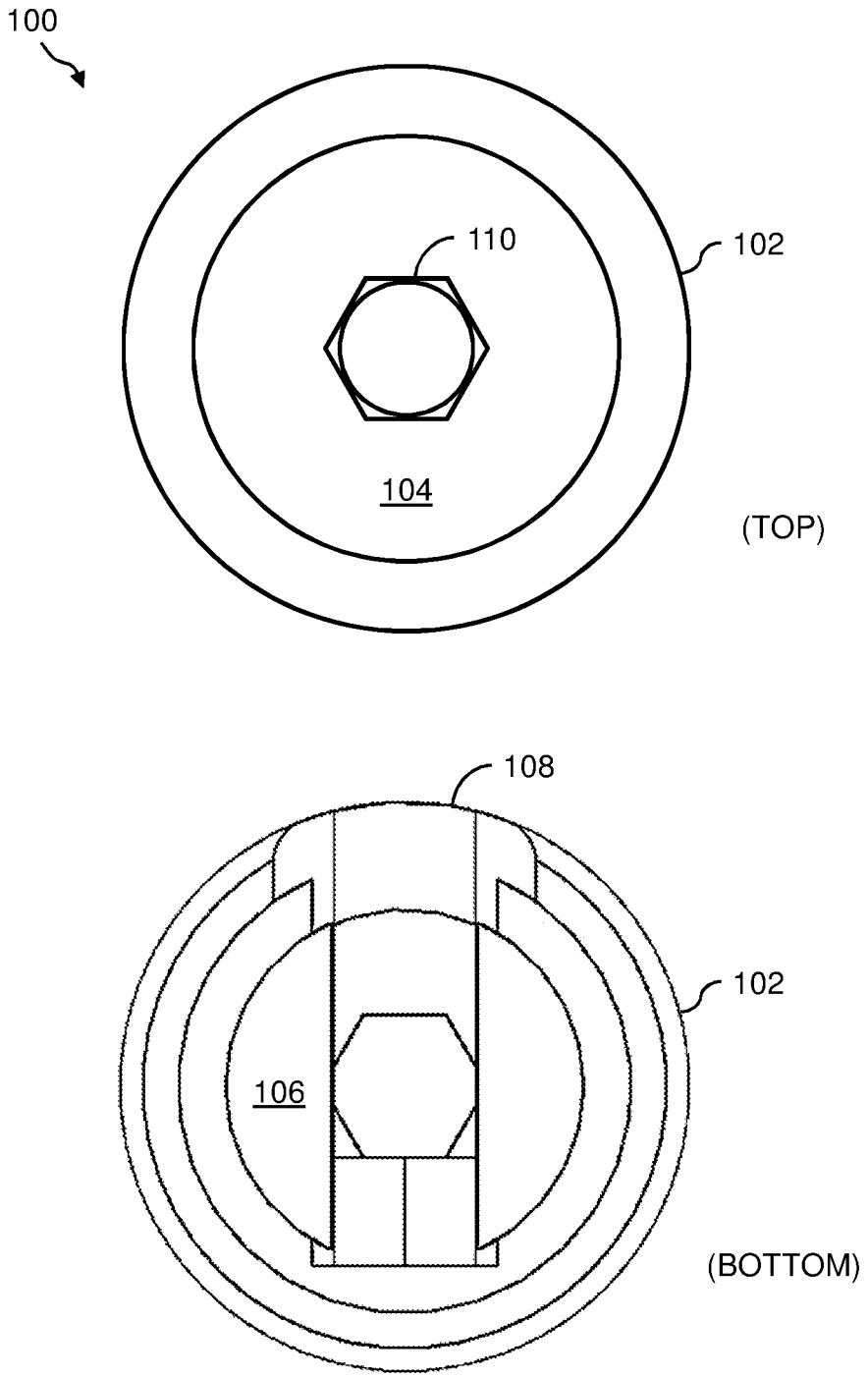
Figure 14:
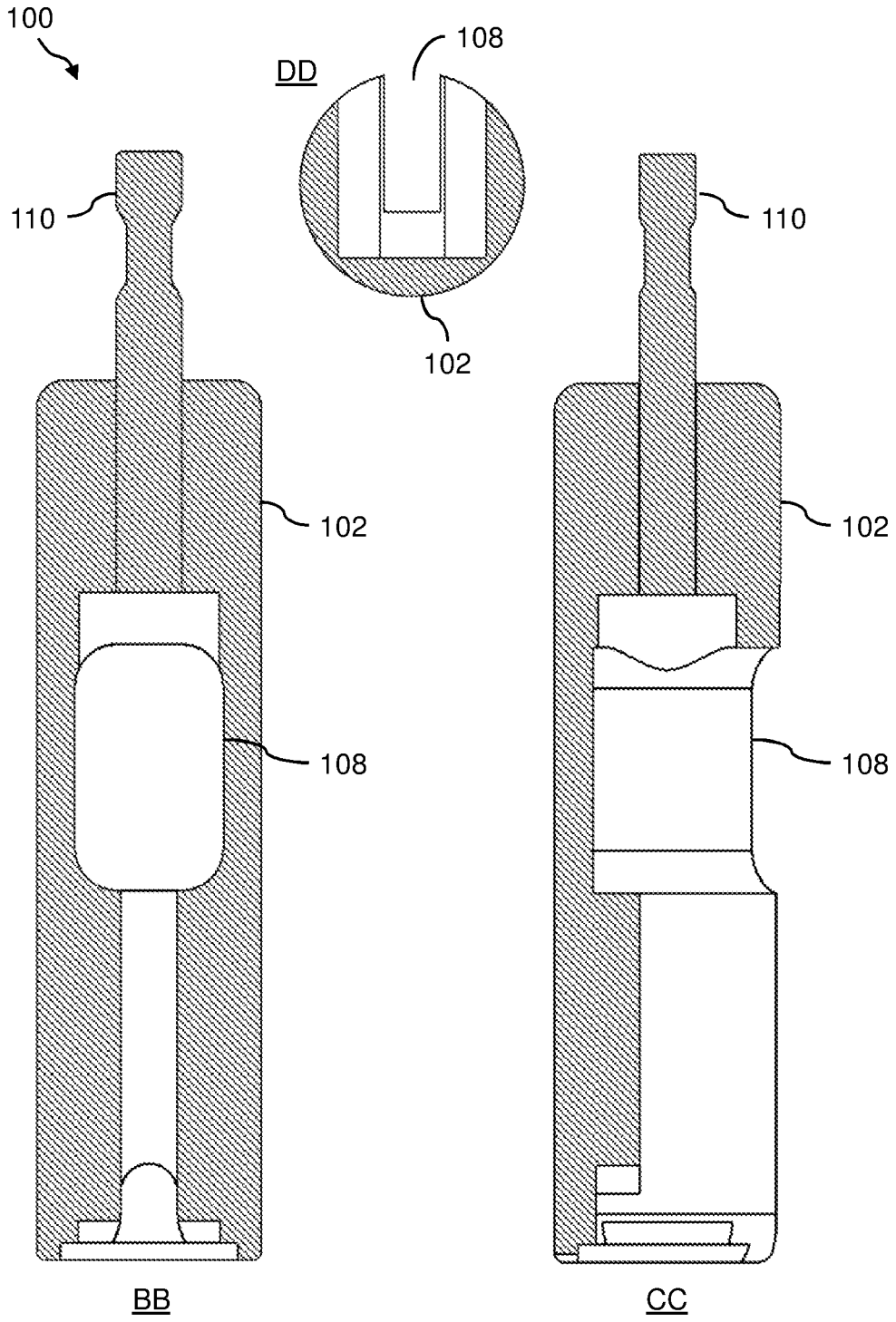
Figure 15:
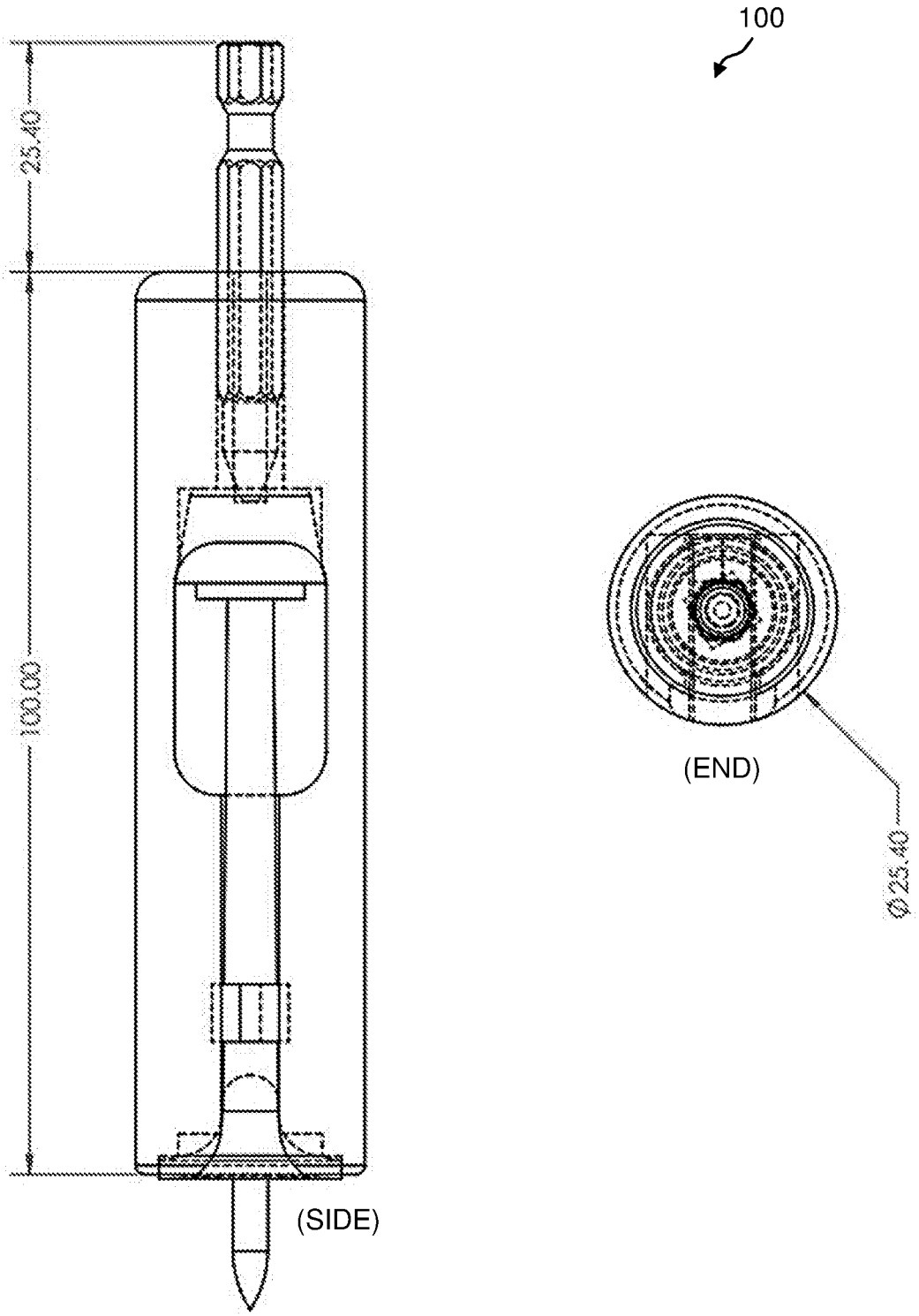
Figure 16:
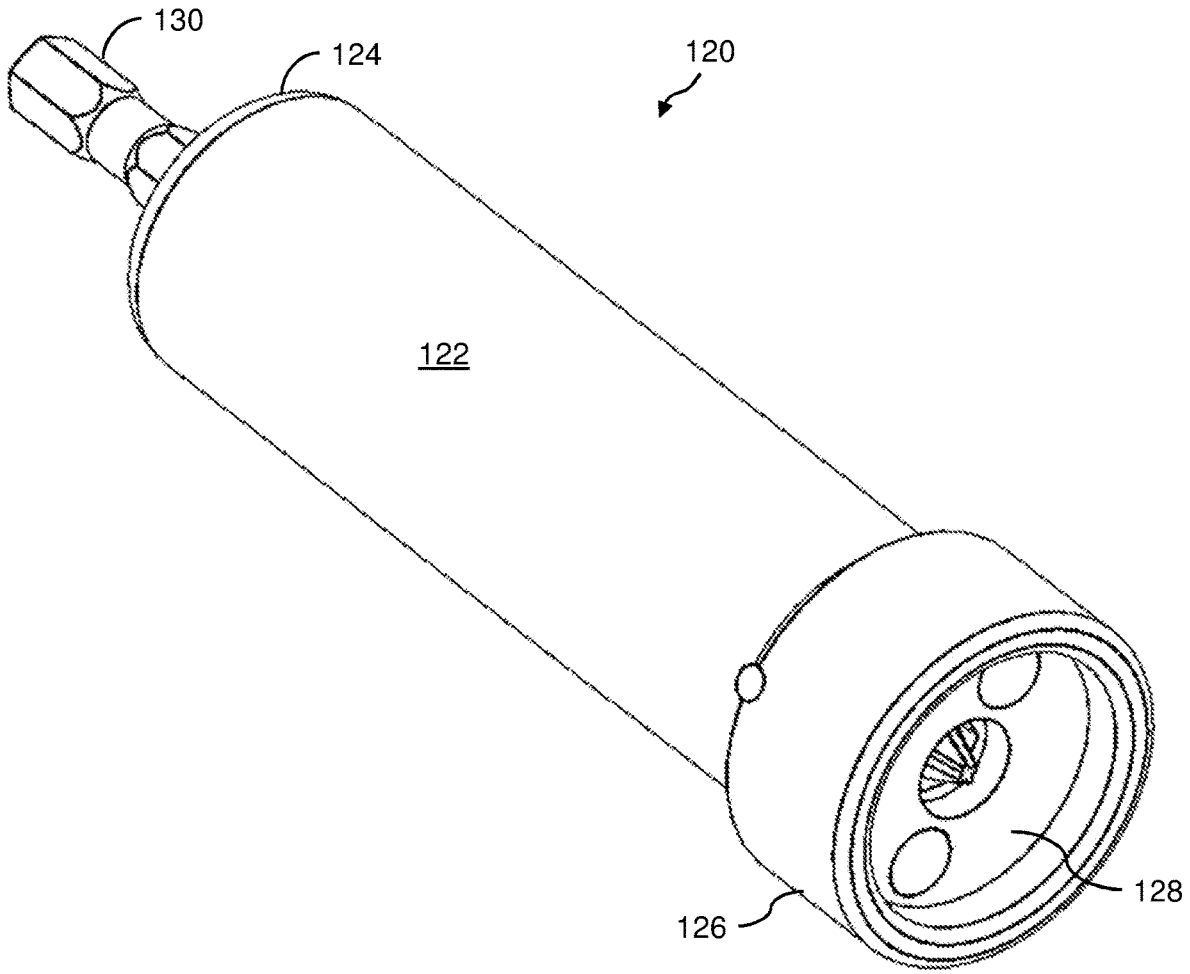
Figure 17:
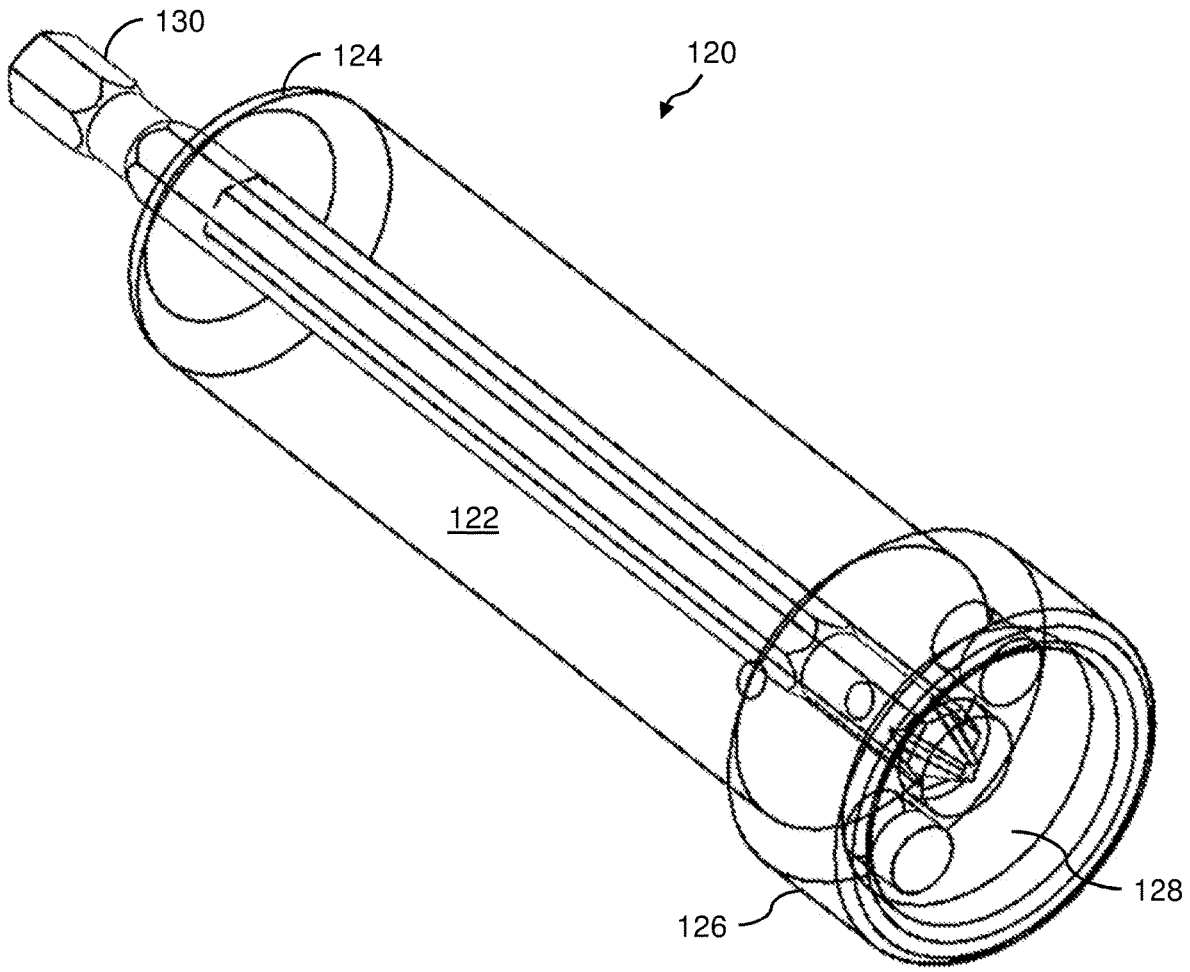
Figure 18:
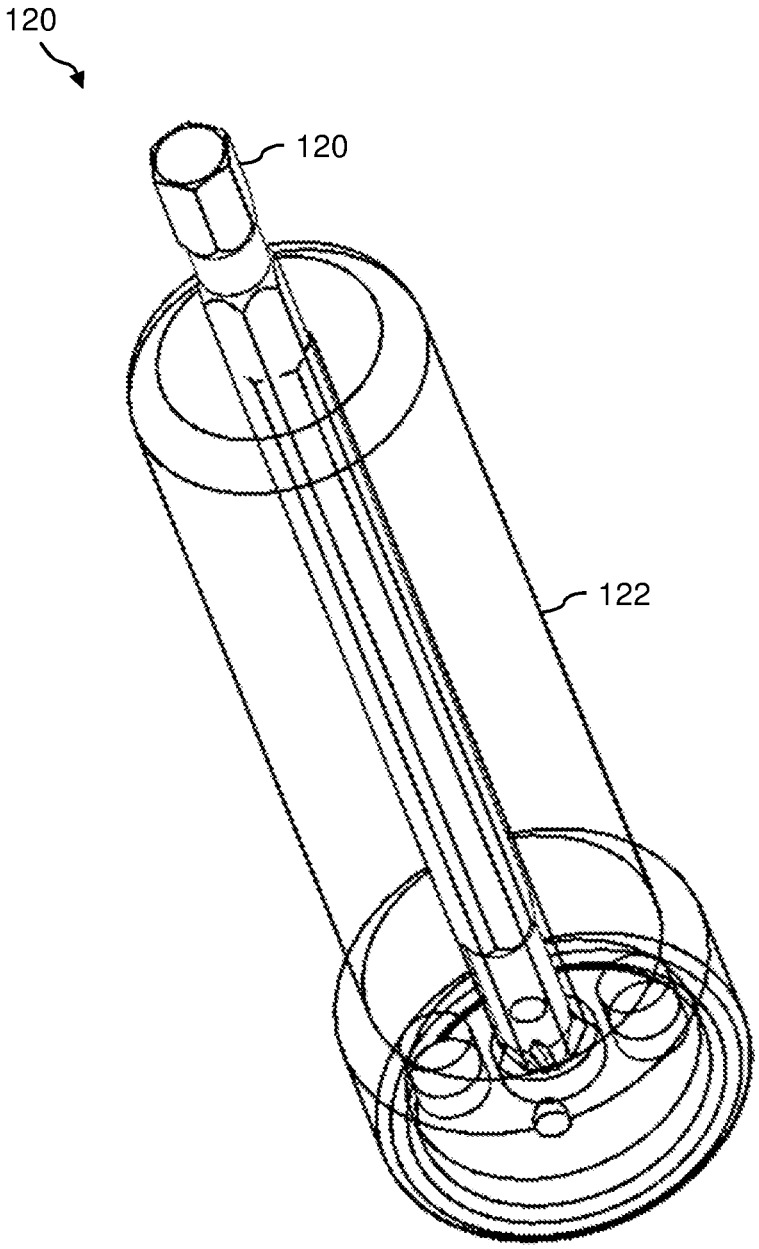
Figure 19:
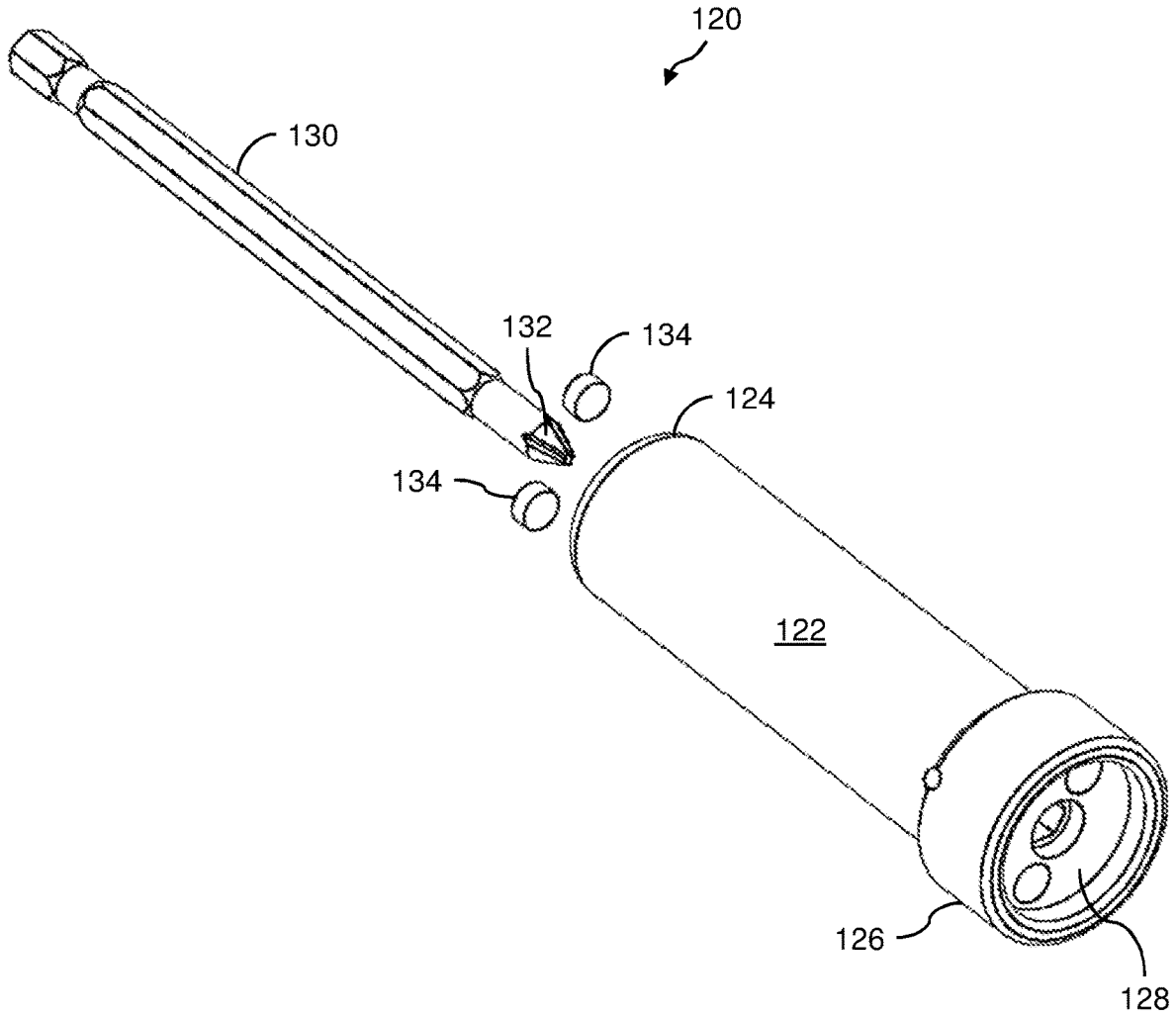
Figure 20:
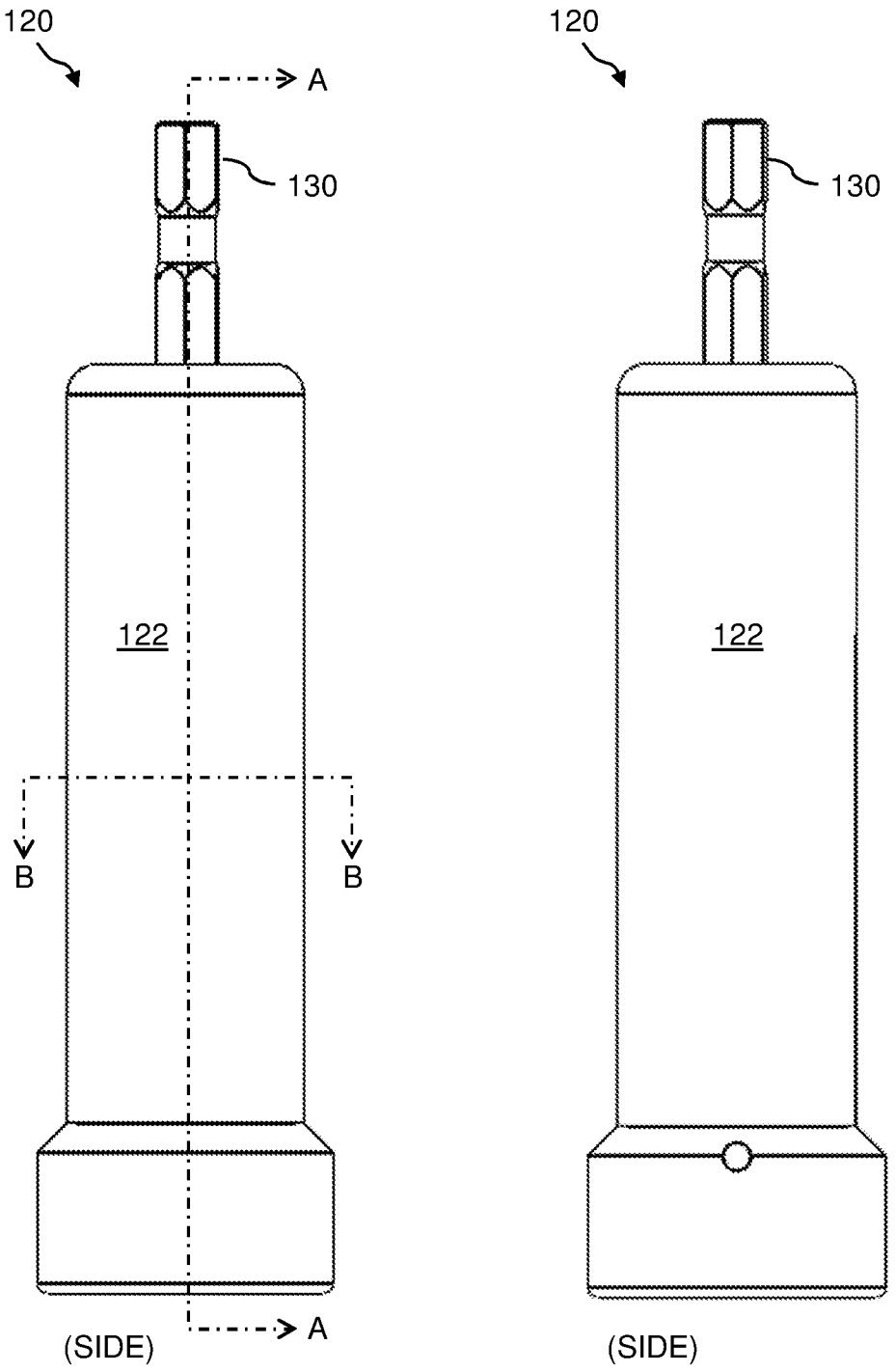
Figure 21:
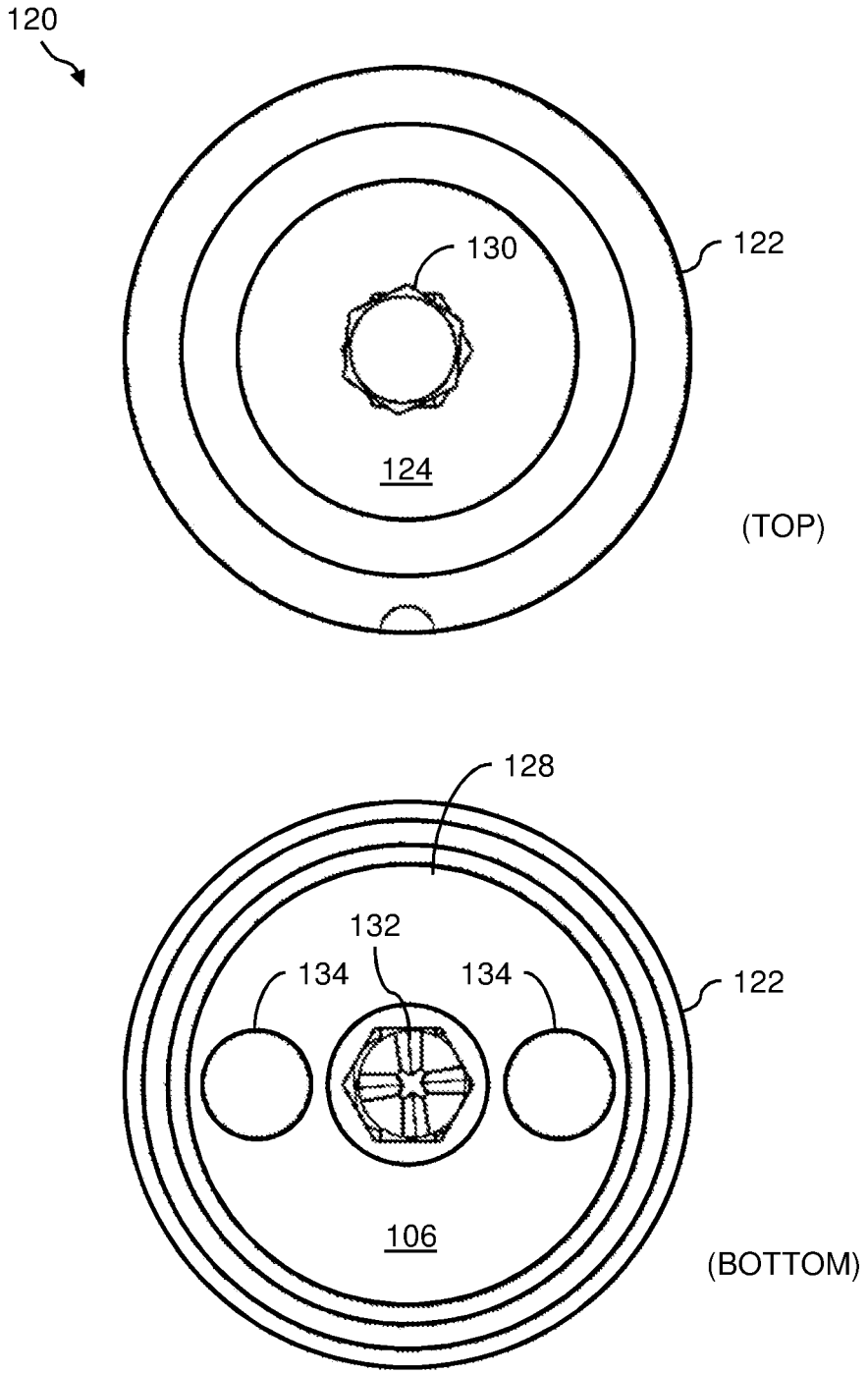
Figure 22:
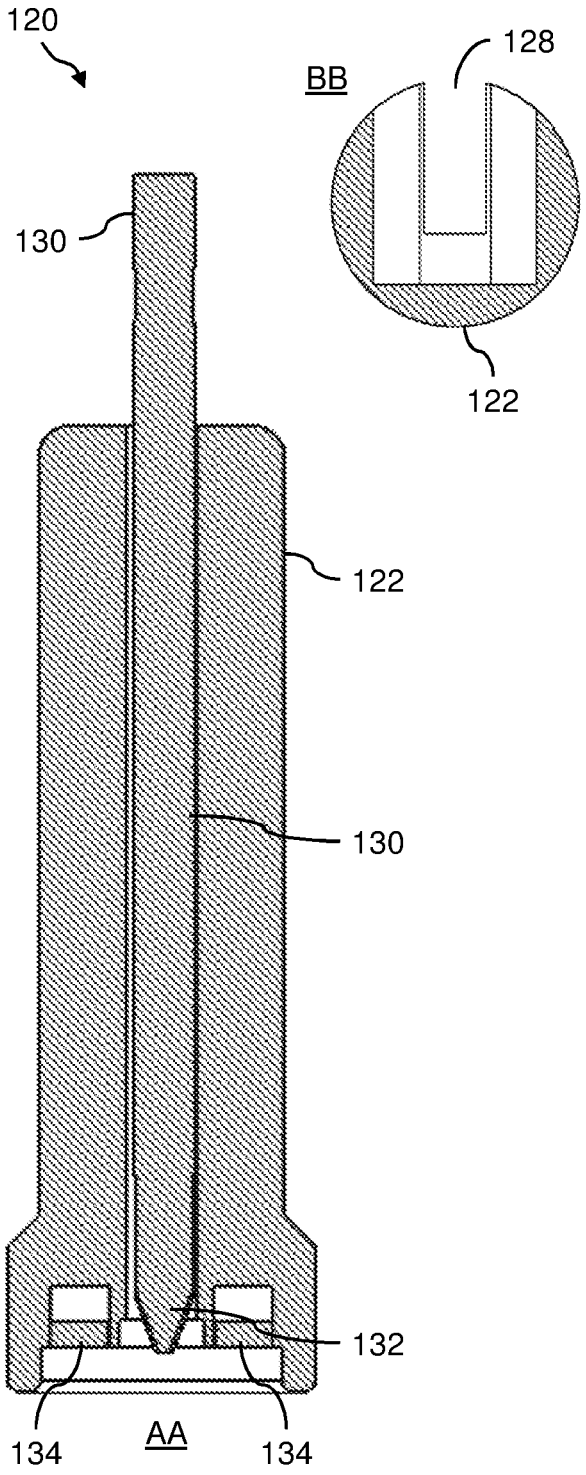
Figure 23:
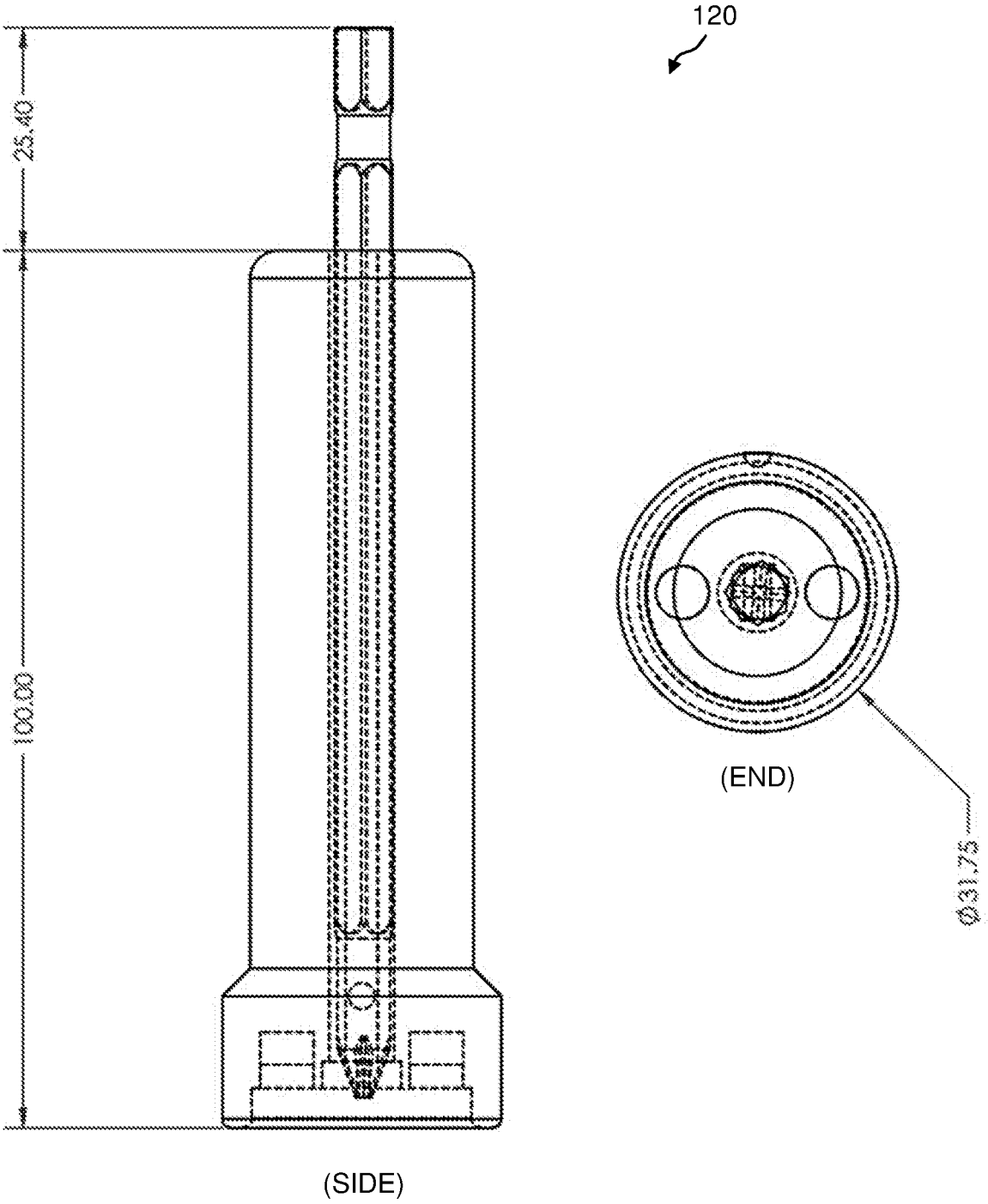
Figure 24:
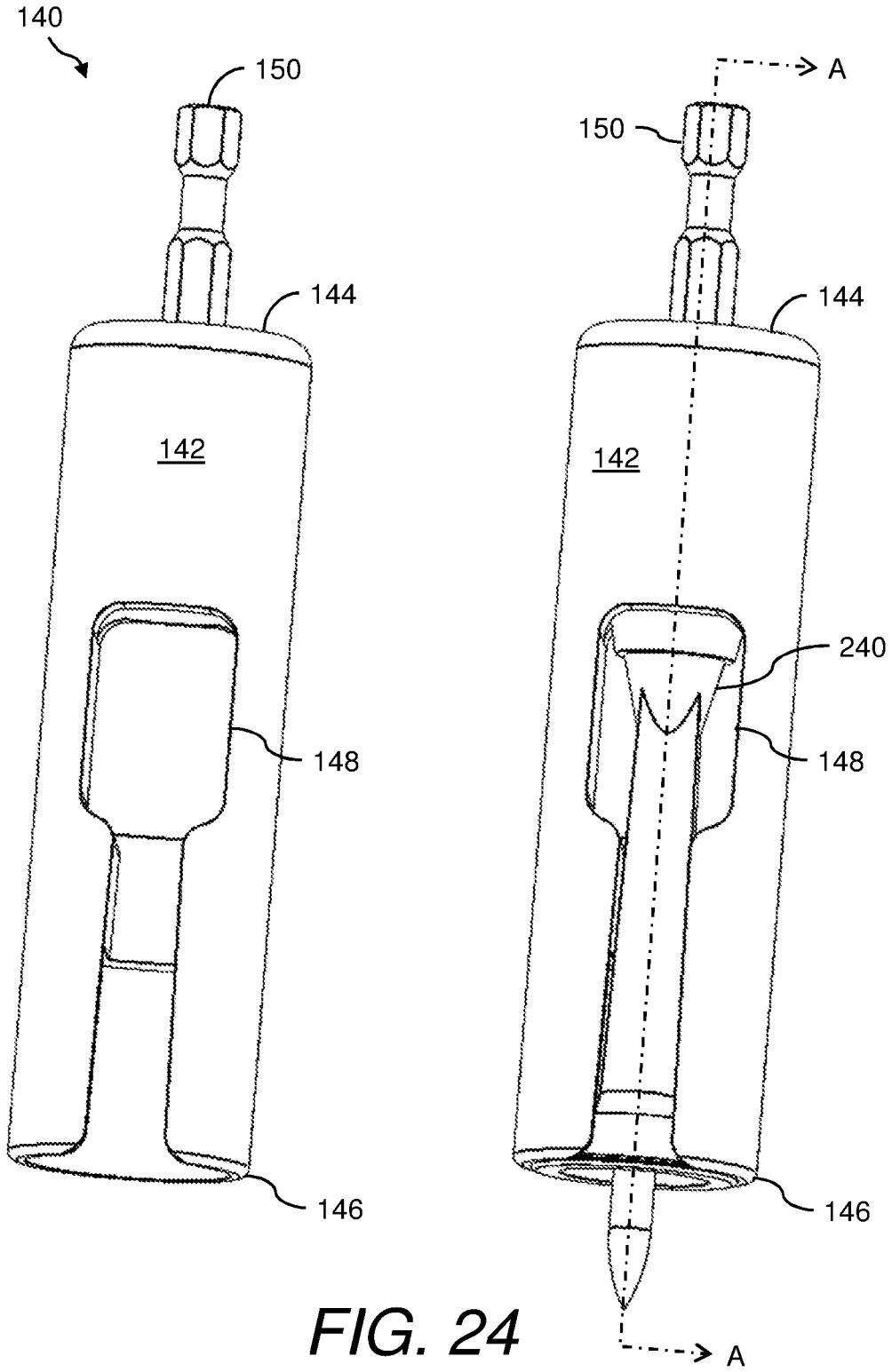
Figure 25:
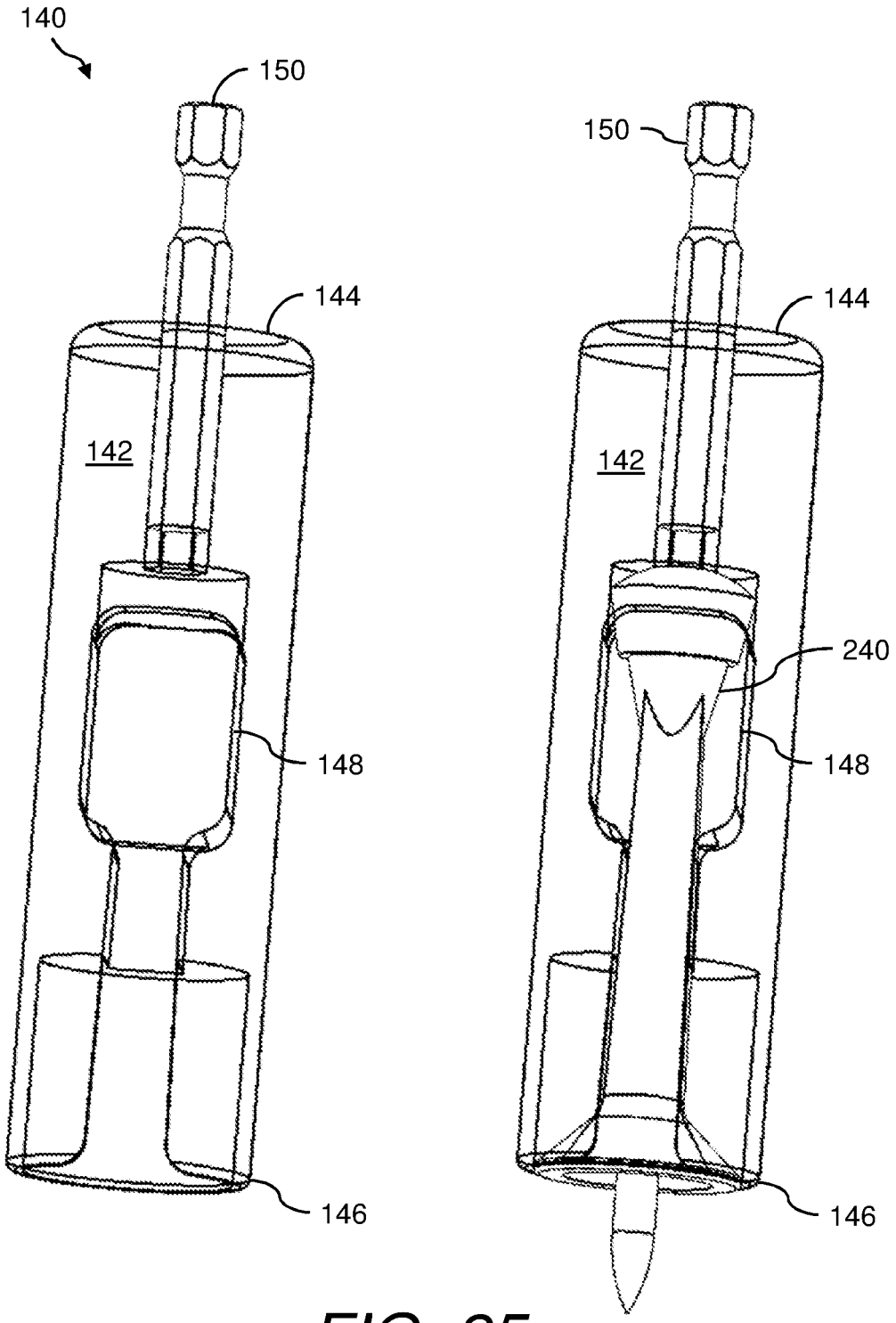
Figure 26:
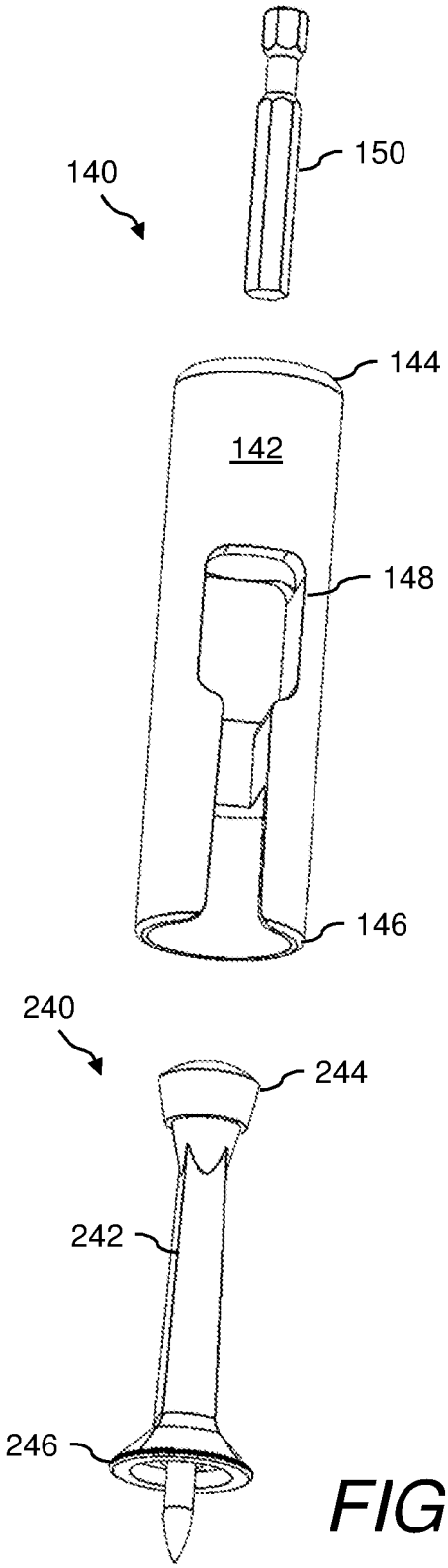
Figure 27:
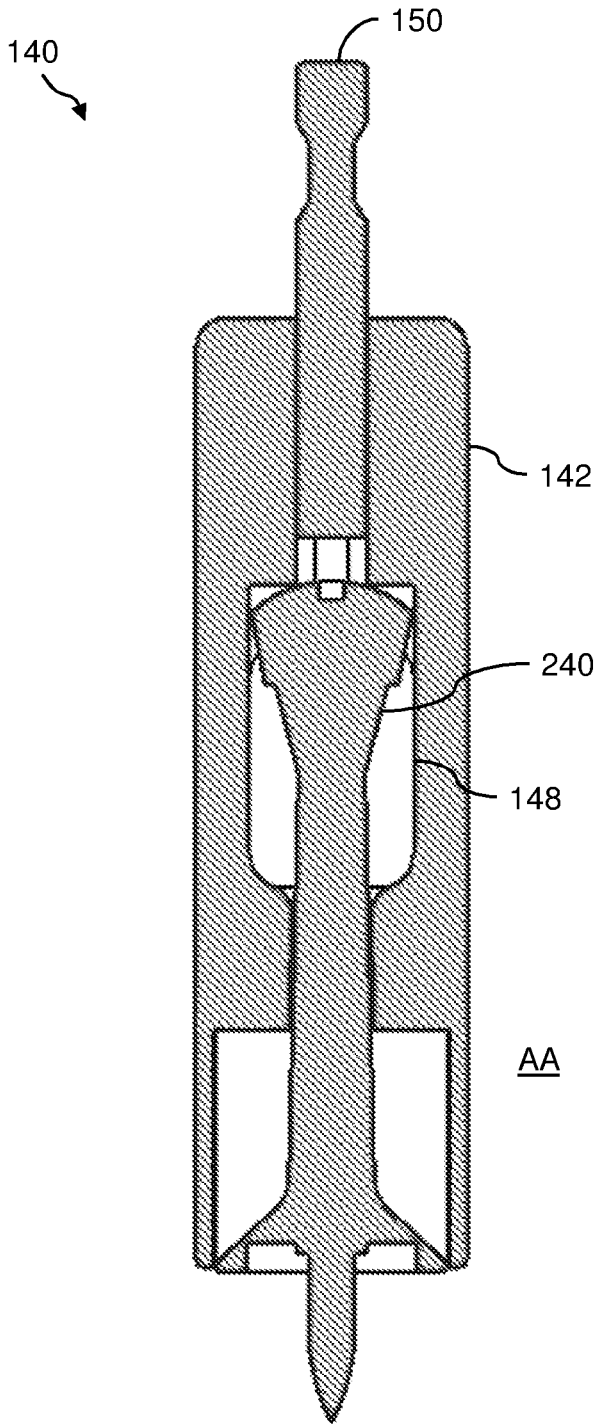
Figure 28:
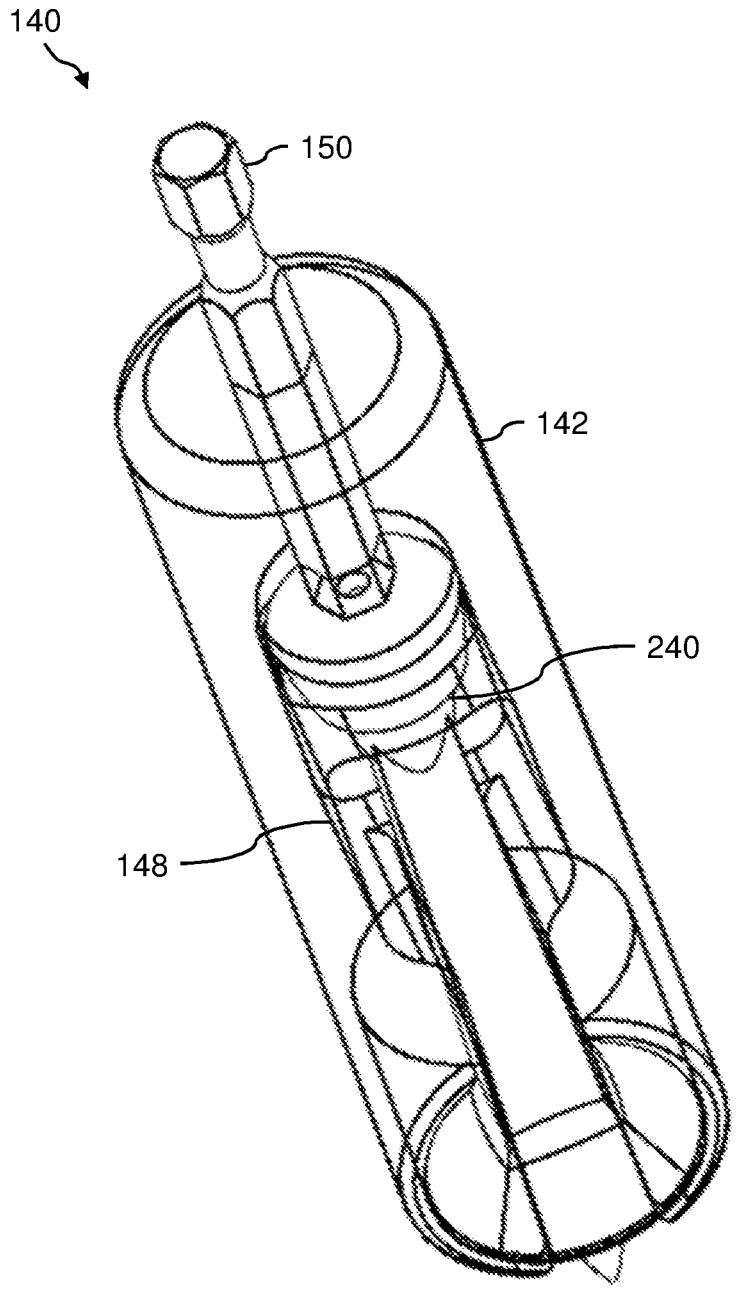
Figure 29:
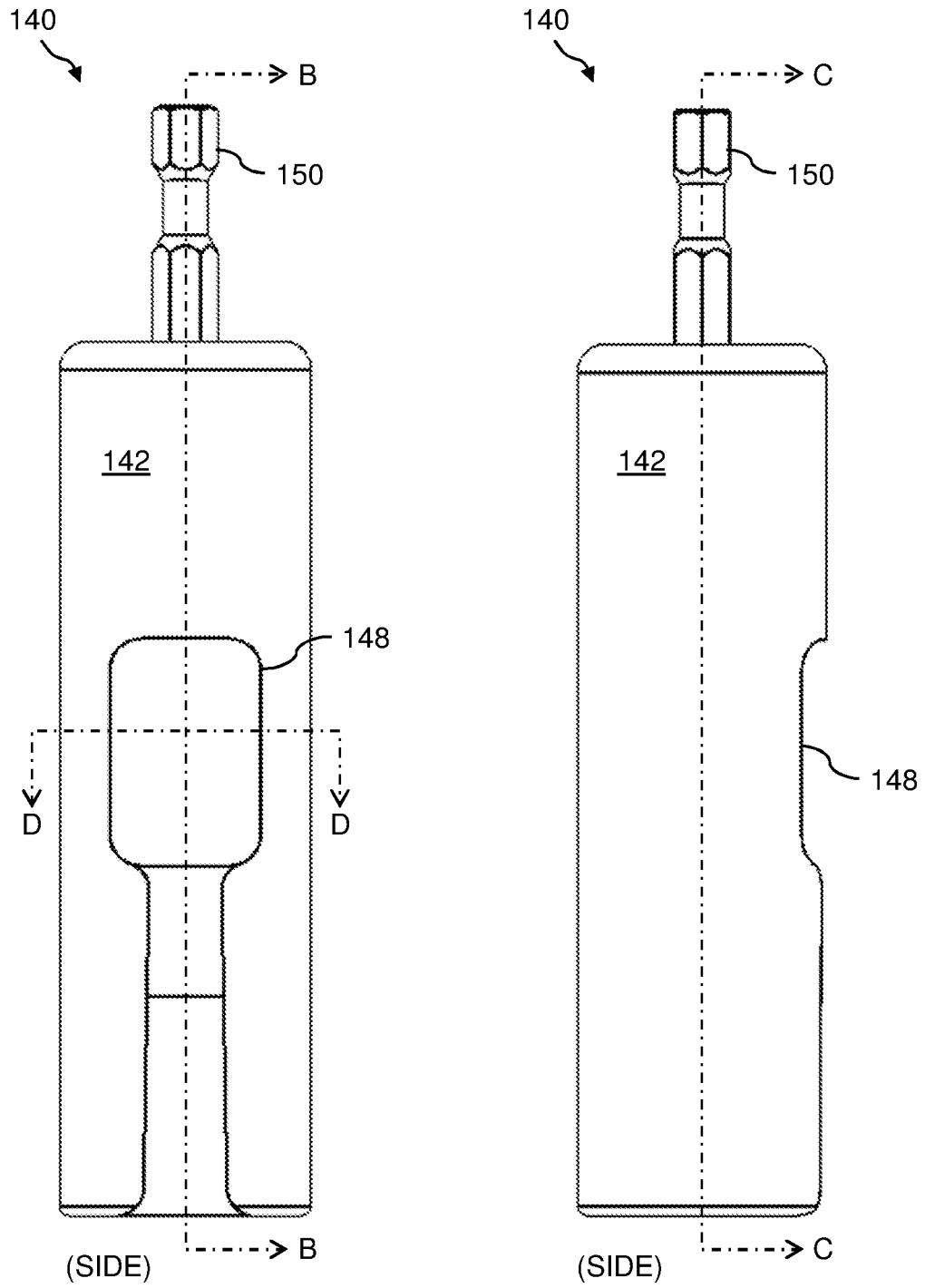
Figure 30:
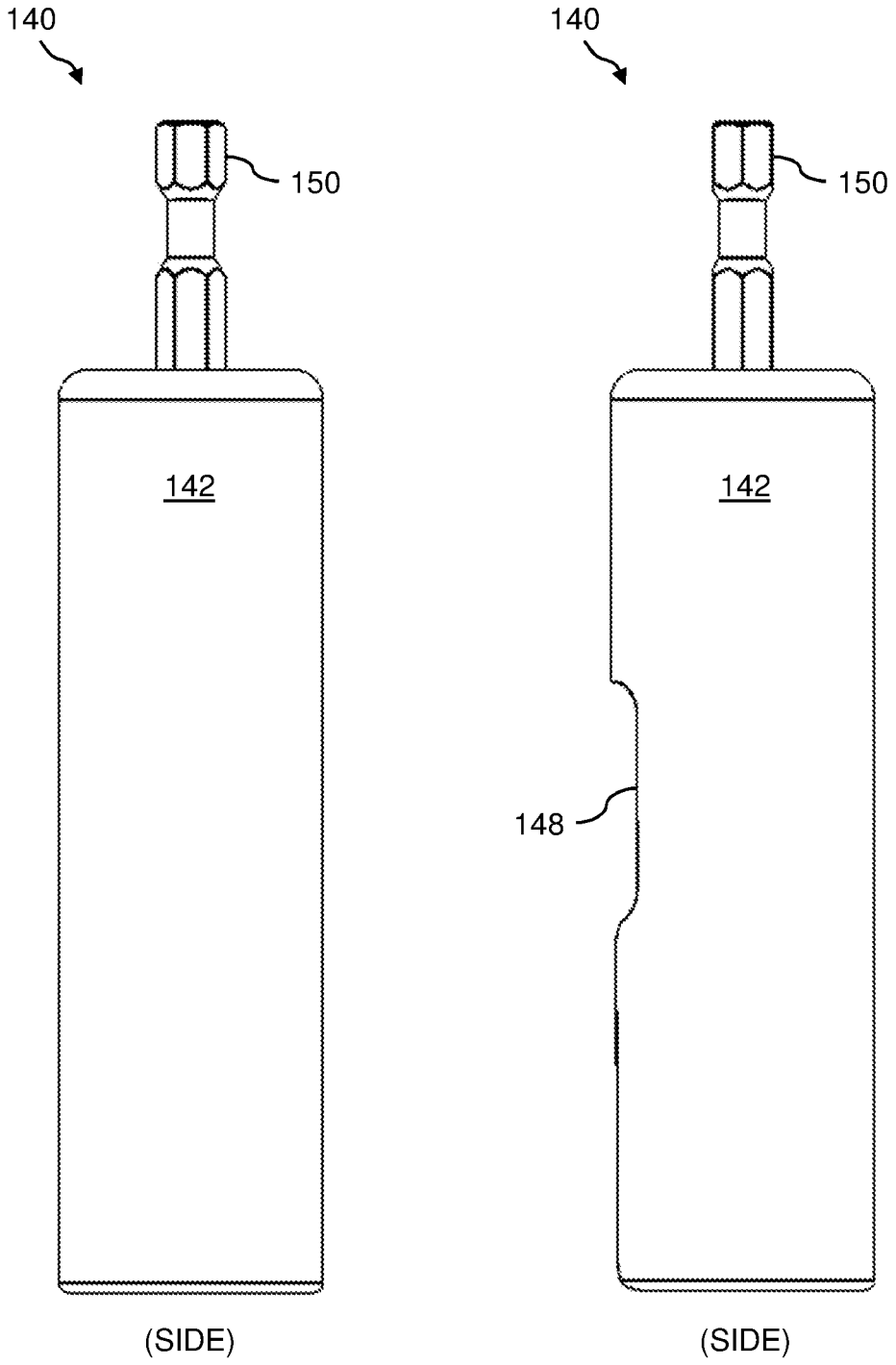
Figure 31:
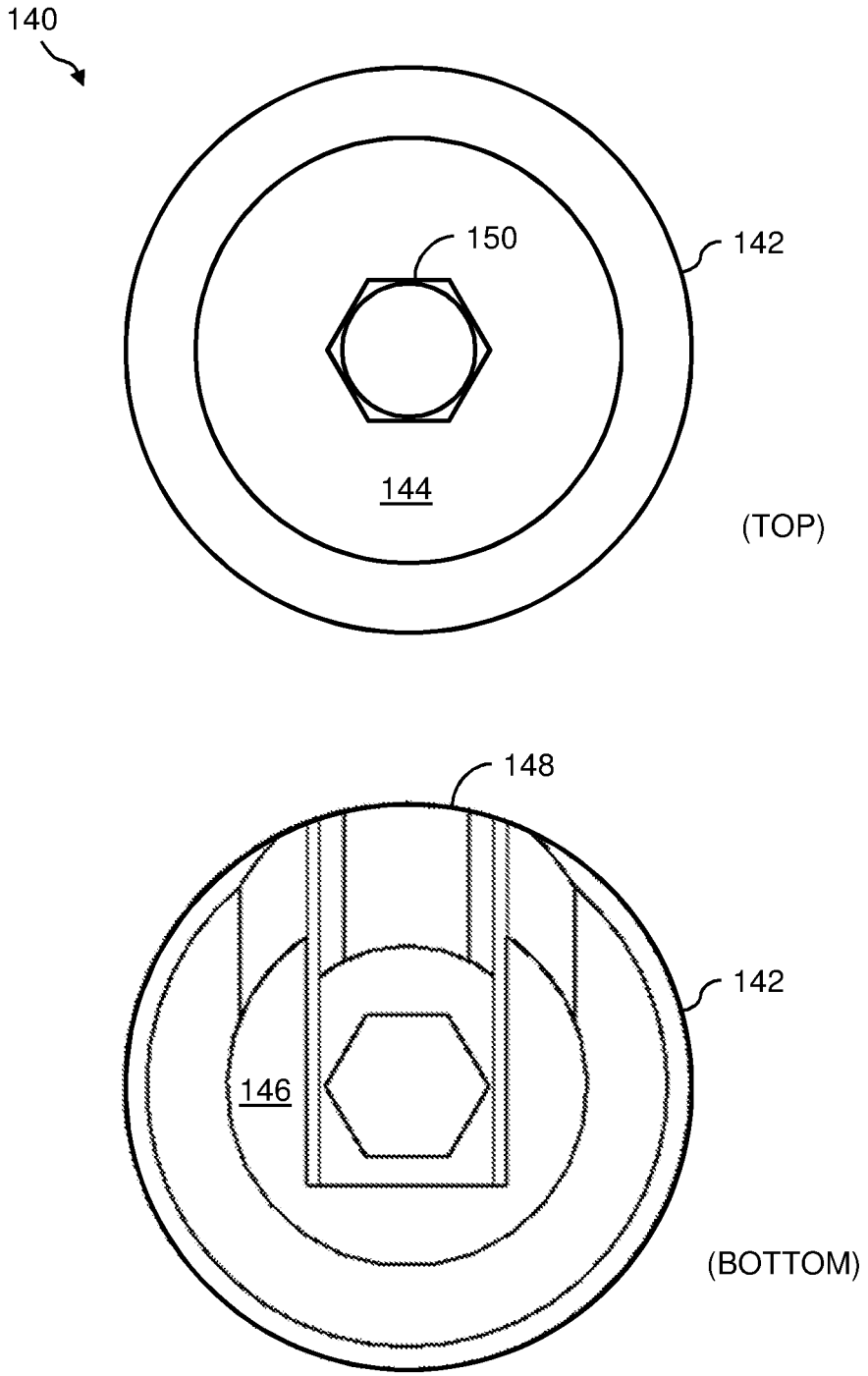
Figure 32:
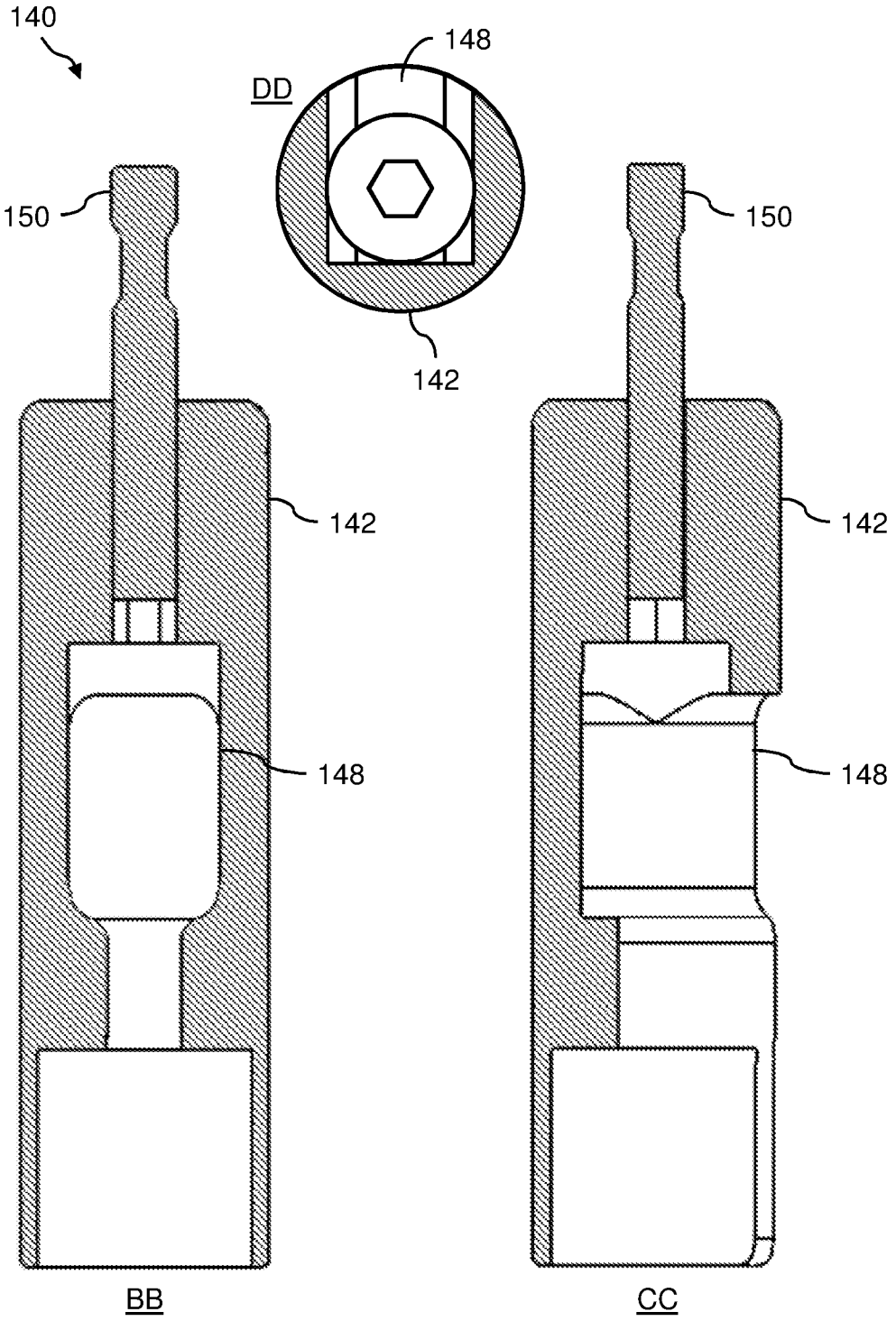
Figure 33:
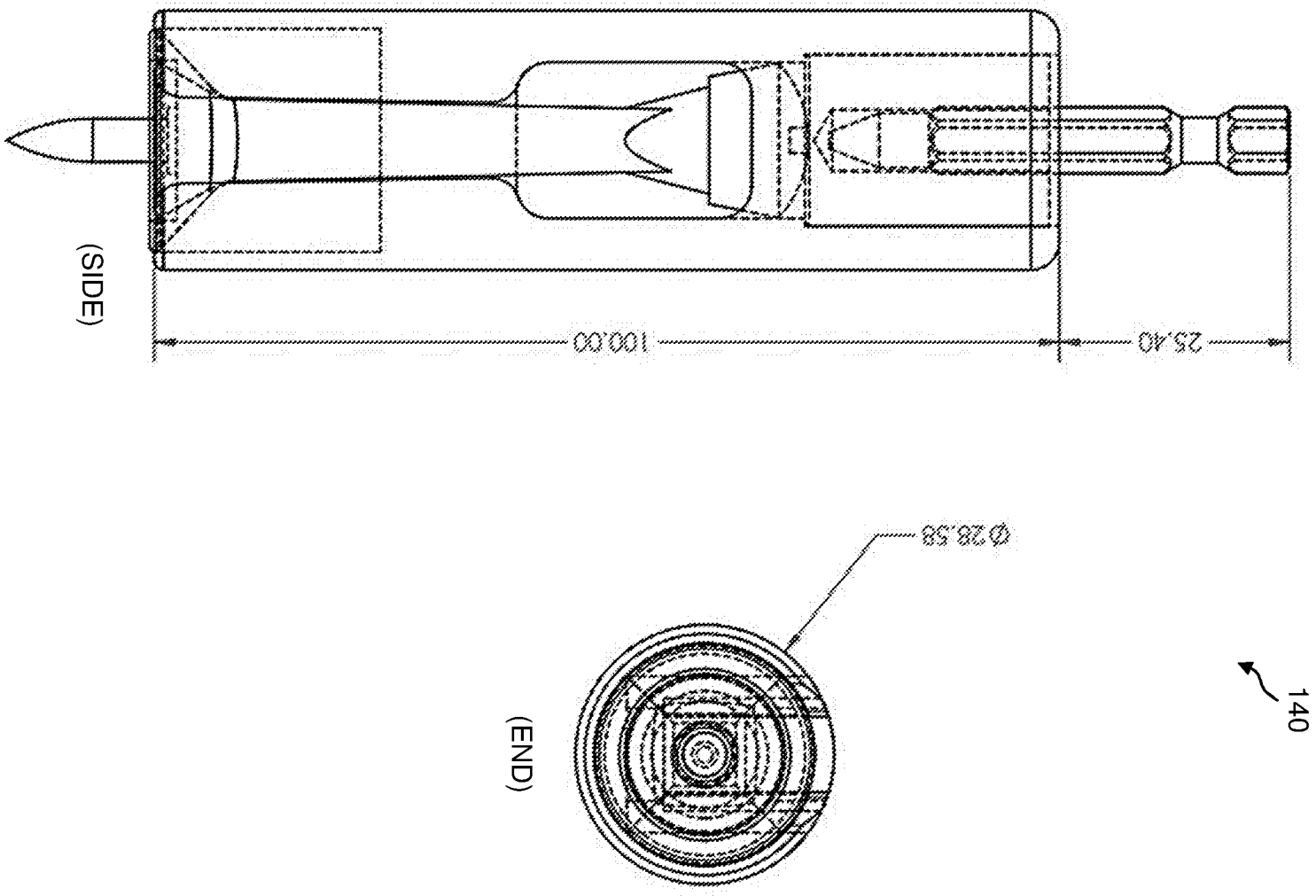
Figure 34:
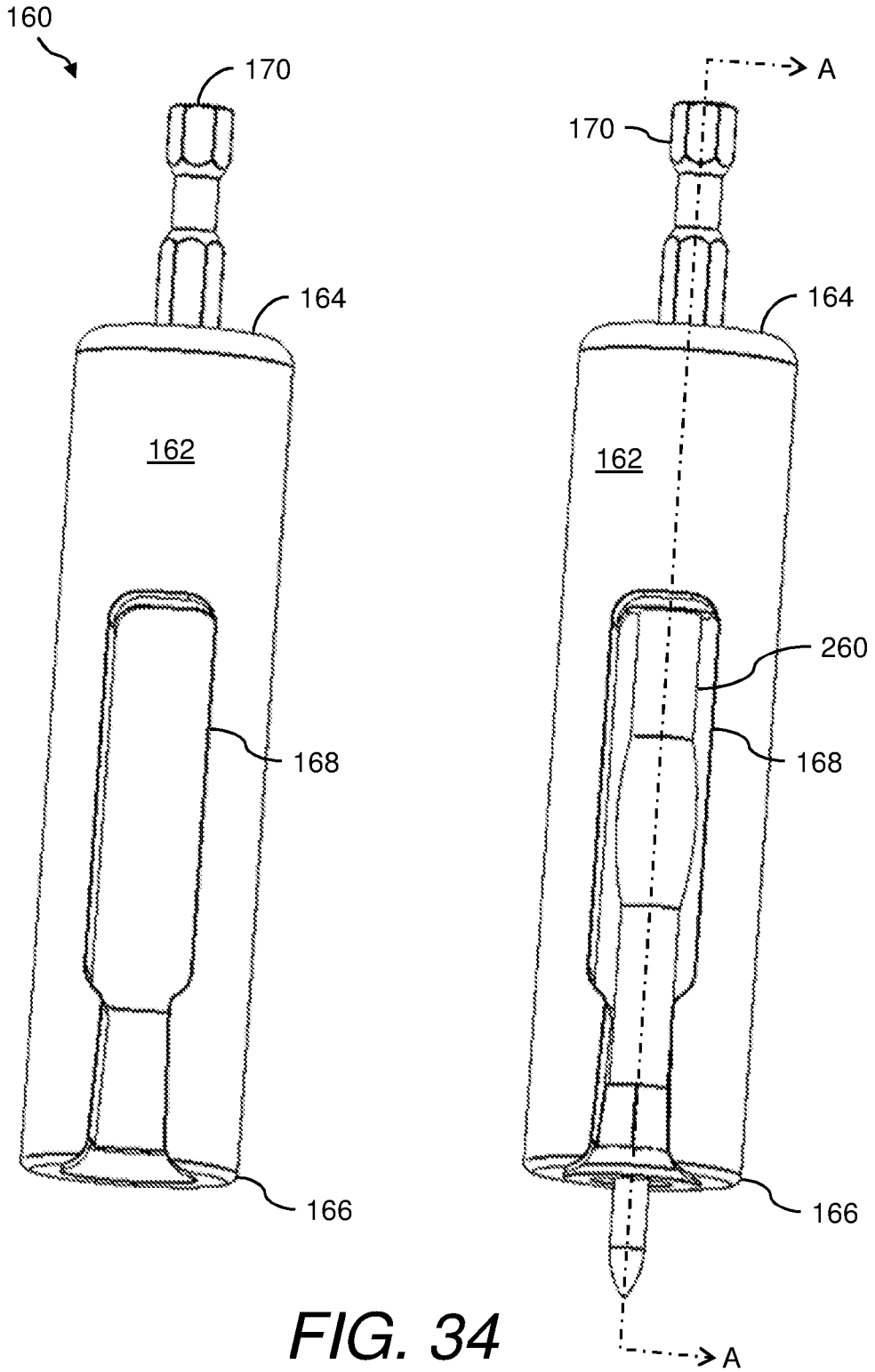
Figure 35:
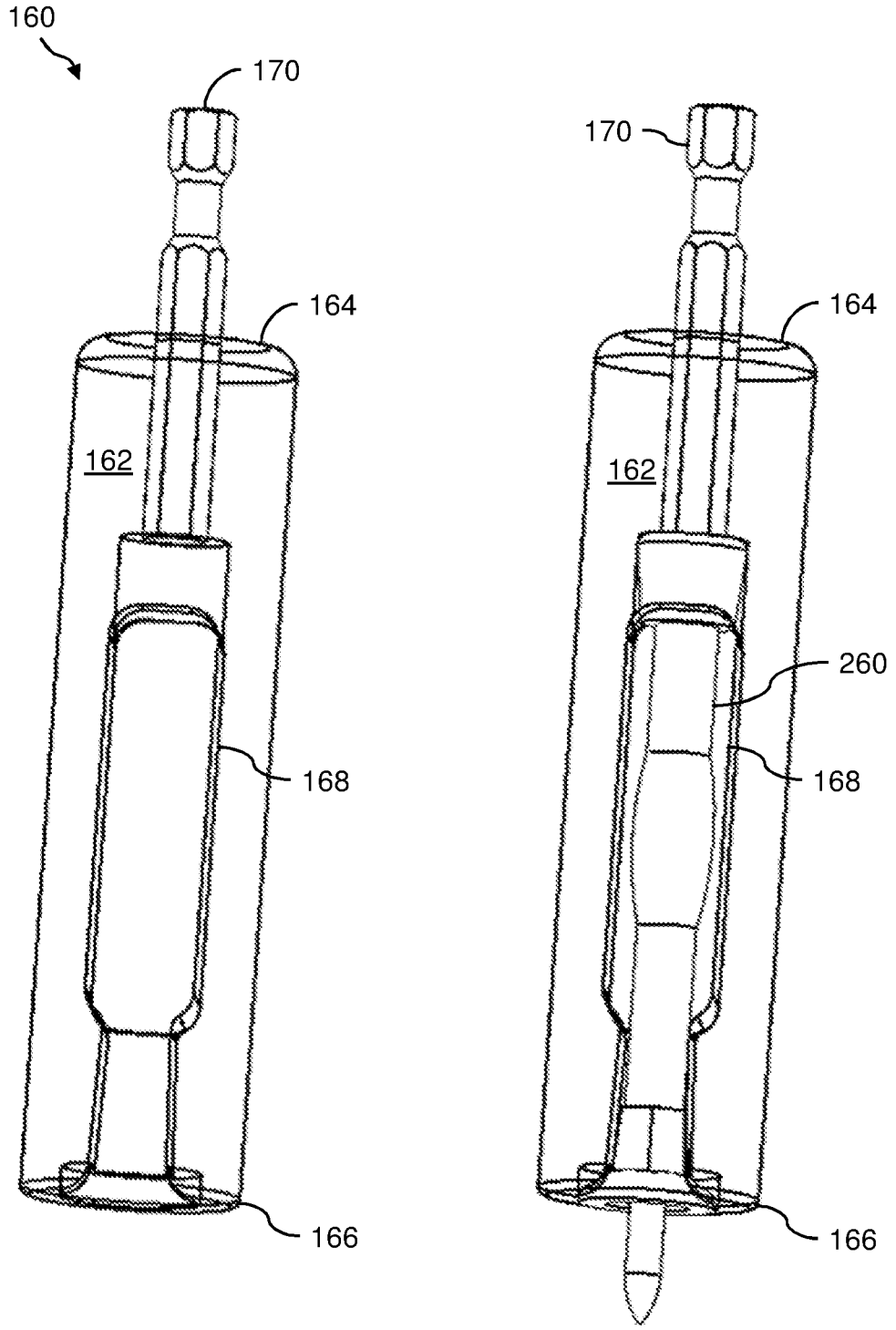
Figure 36:
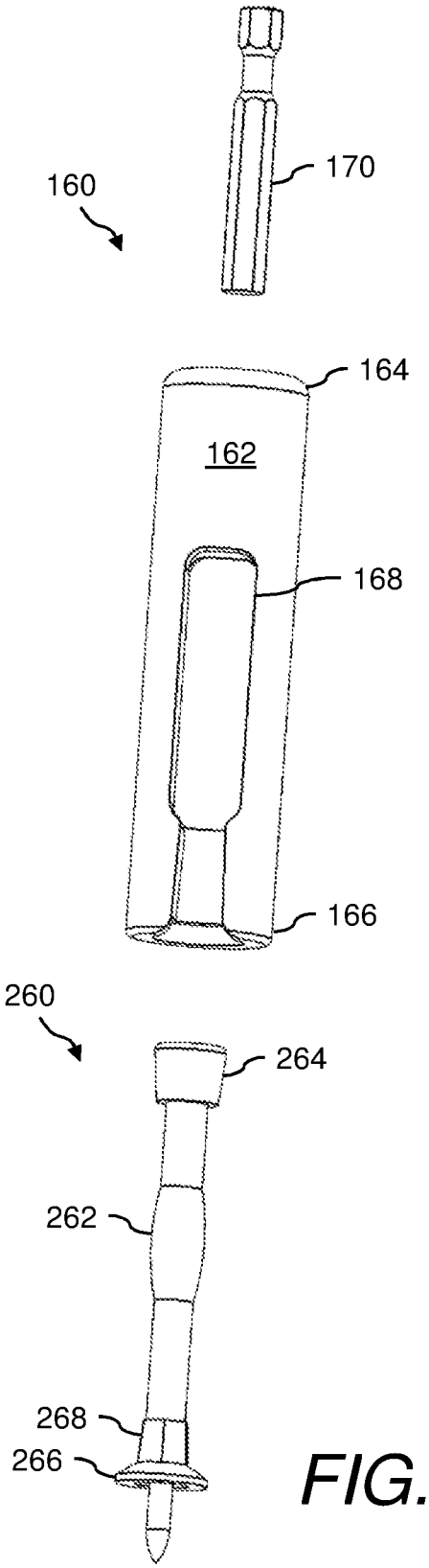
Figure 37:
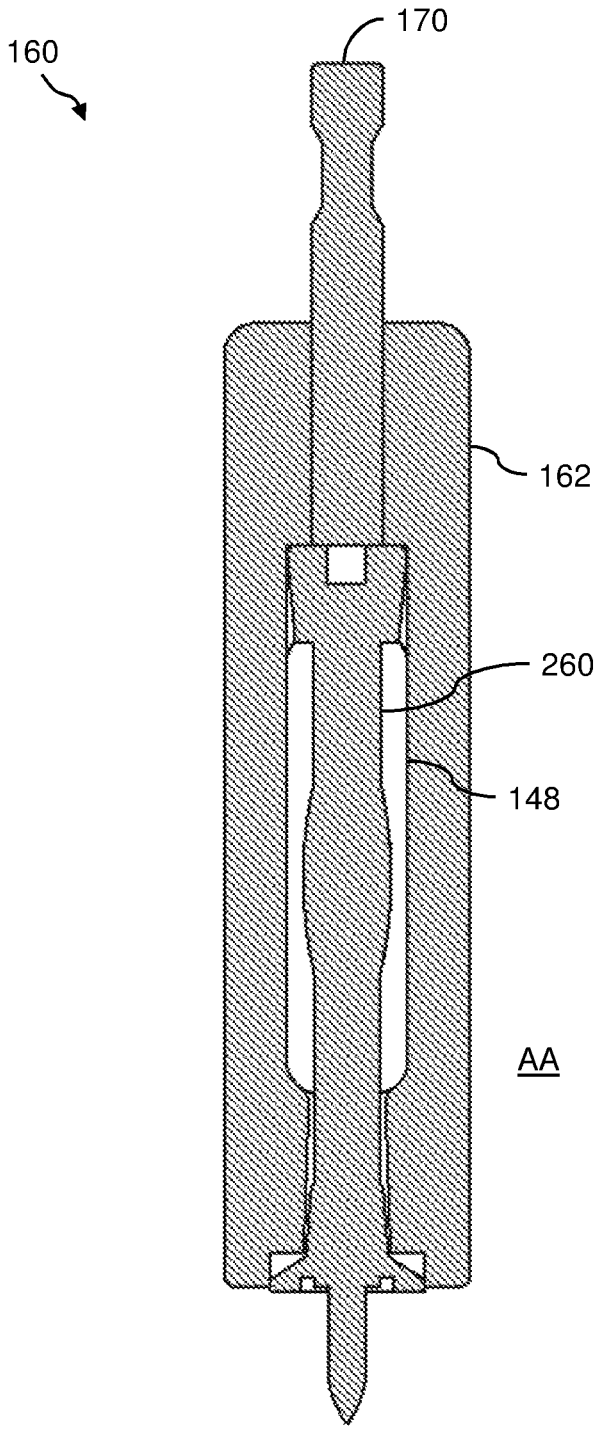
Figure 38:
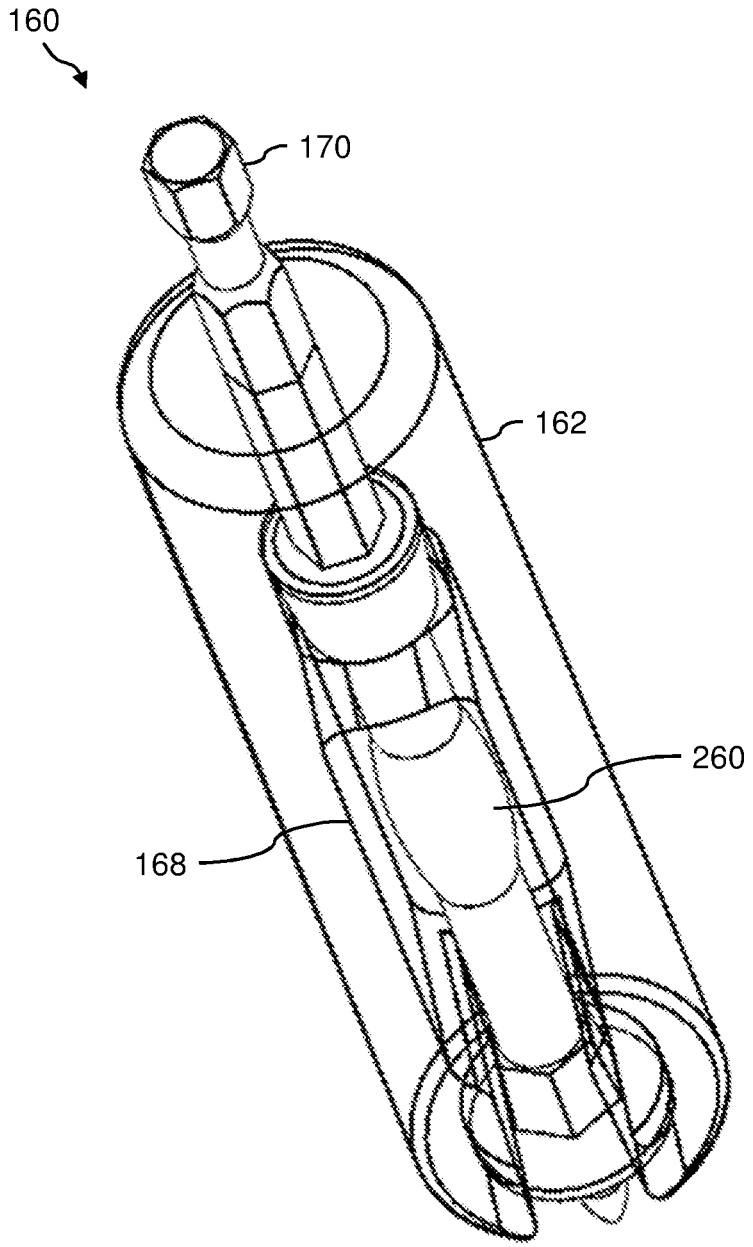
Figure 39:
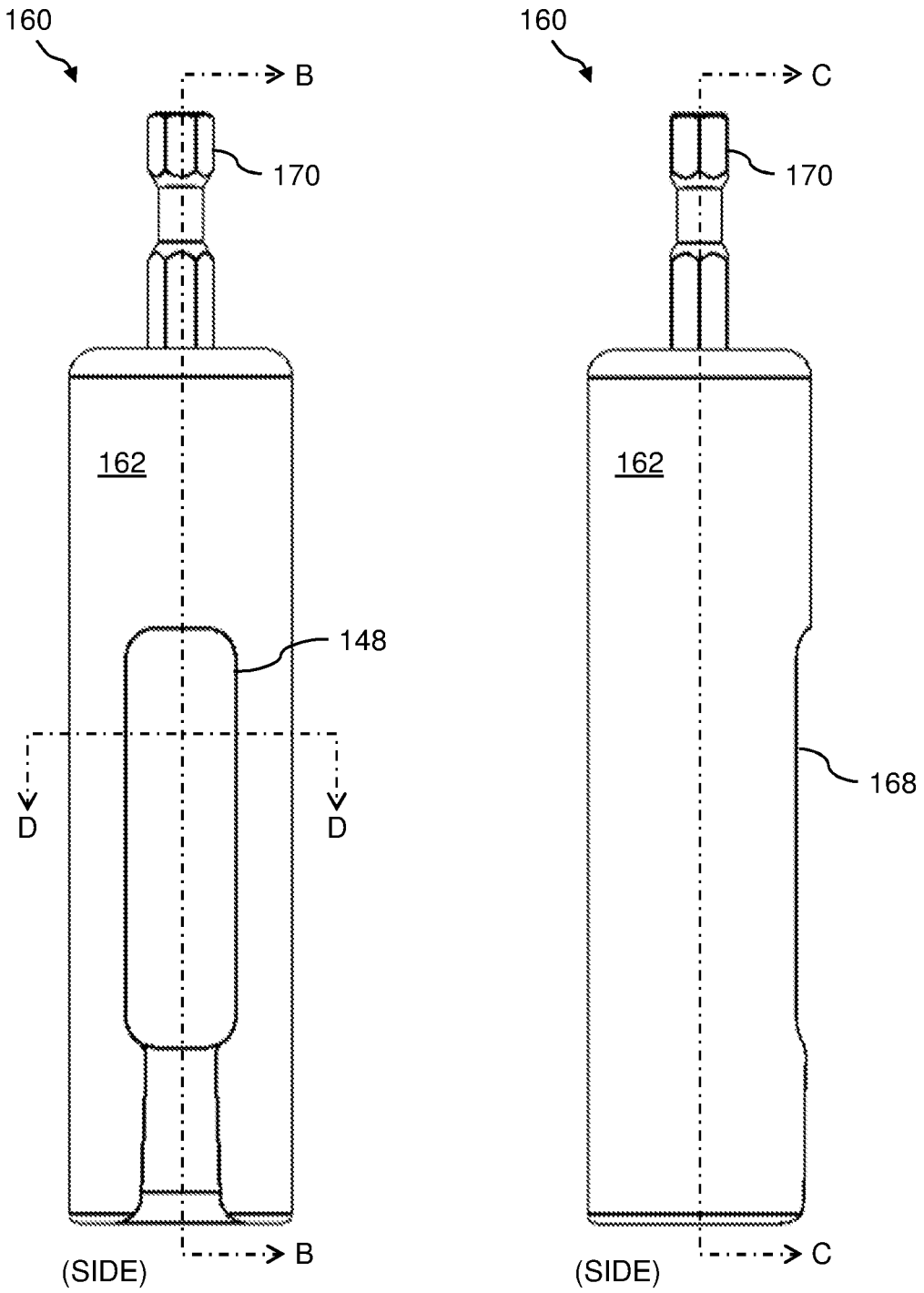
Figure 40:
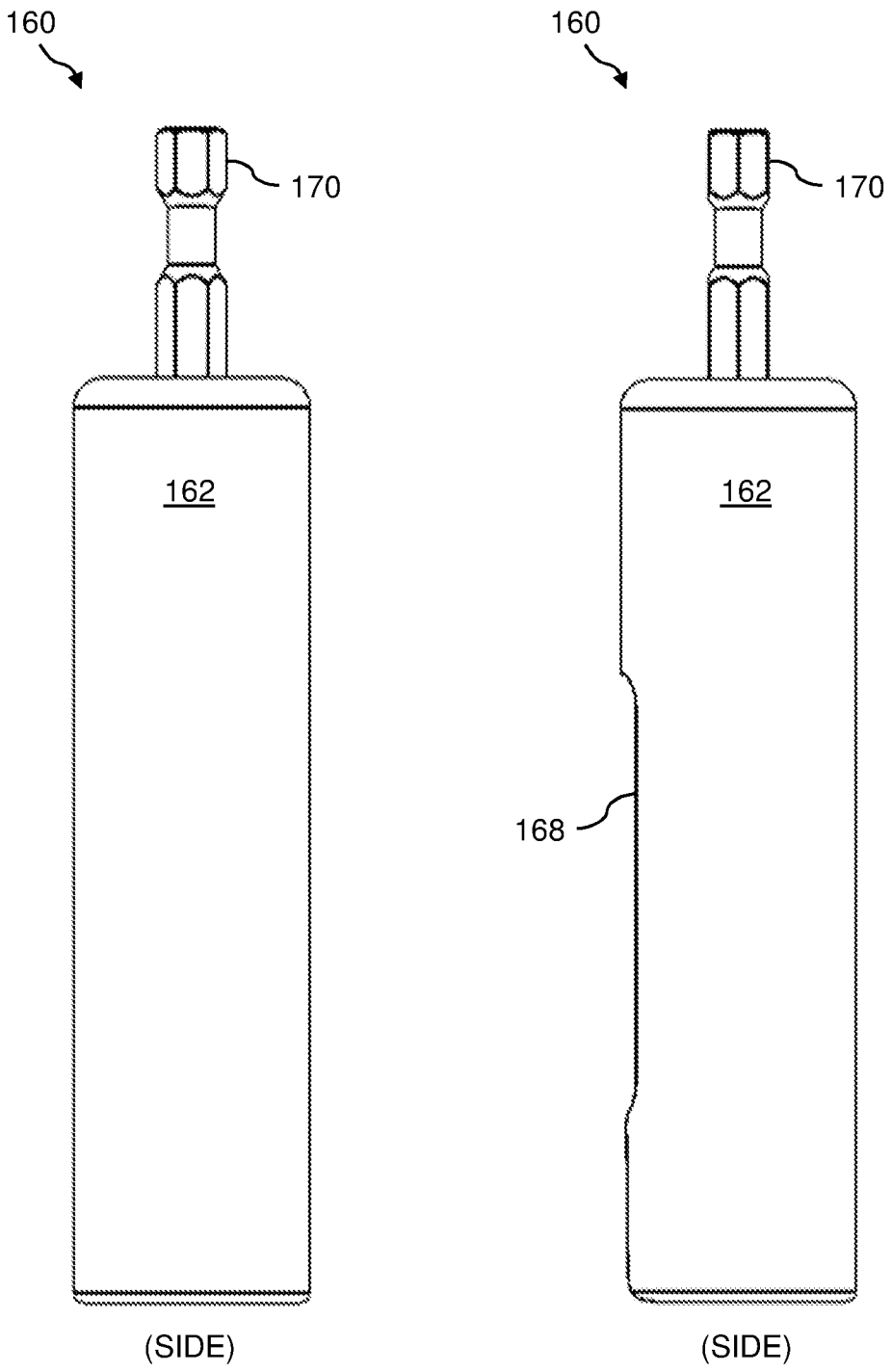
Figure 41:
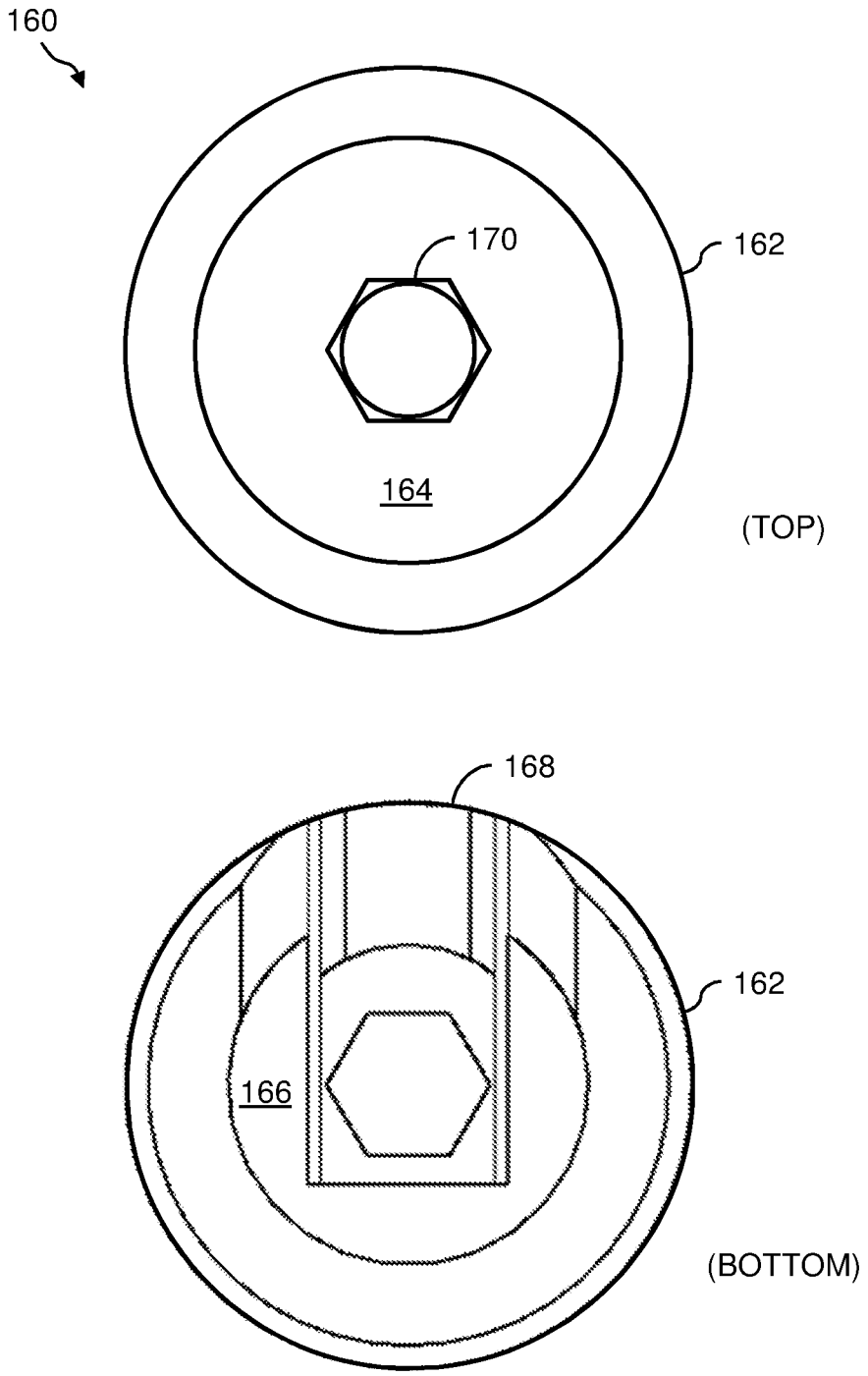
Figure 42:
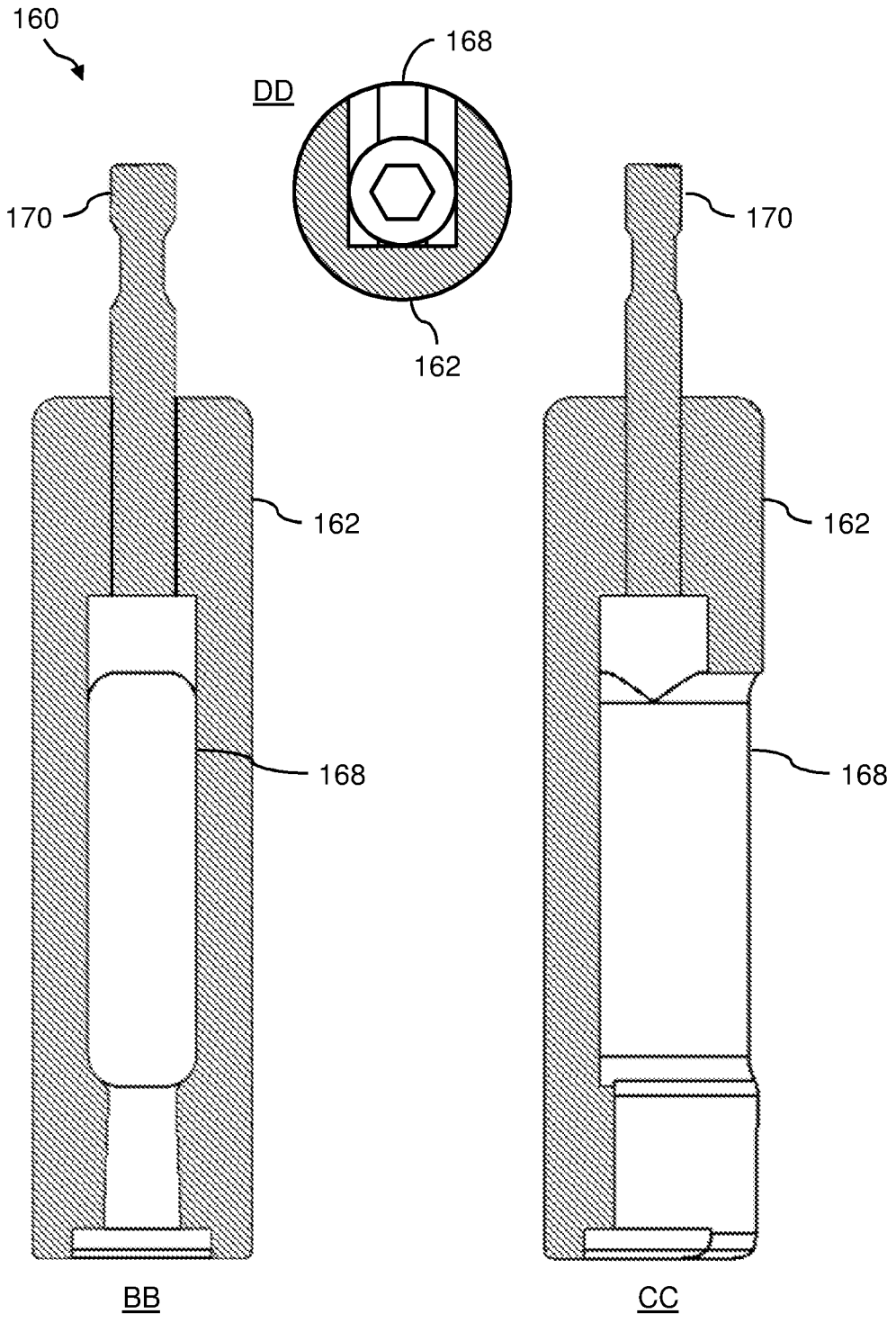
Figure 43:
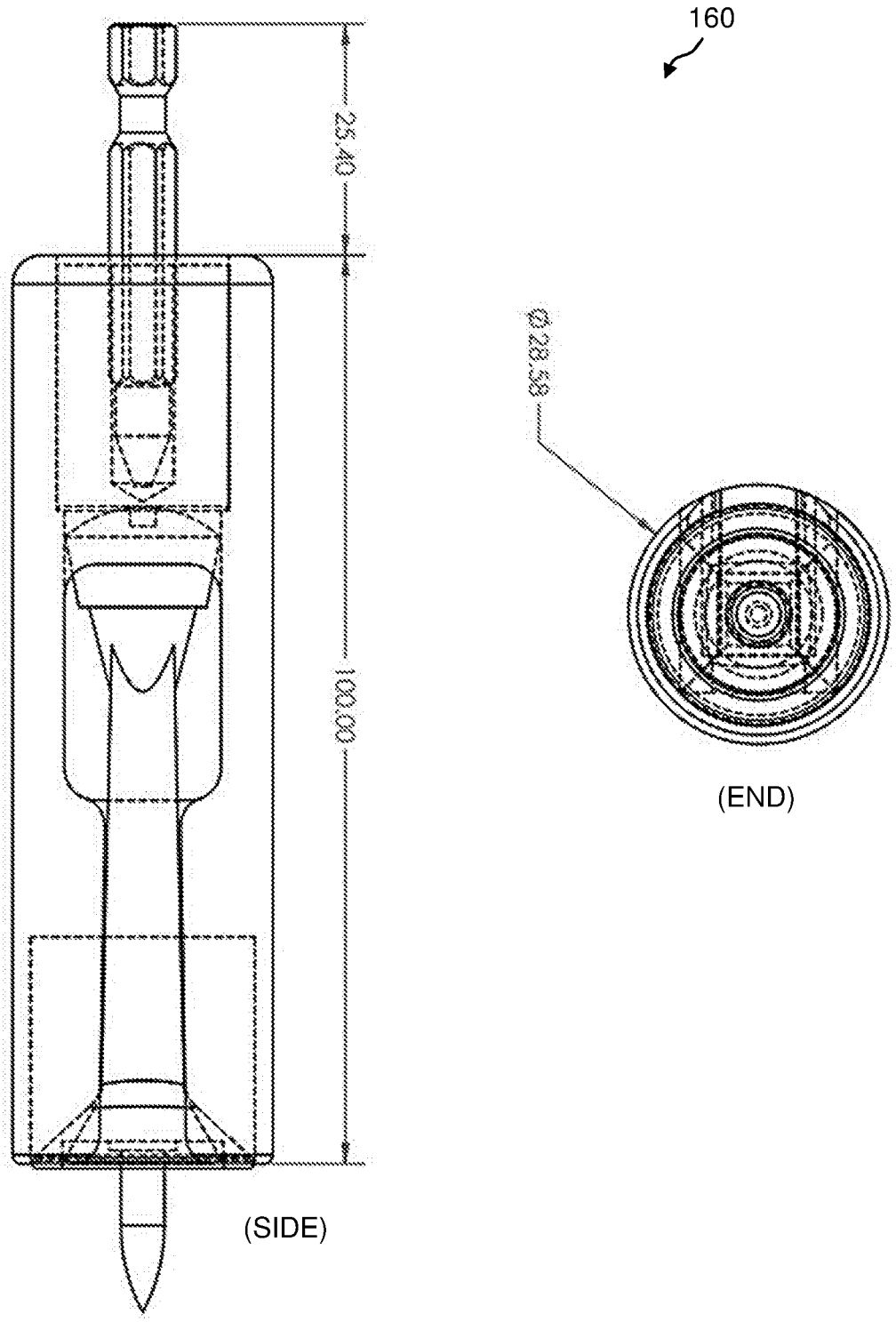
Figure 44:
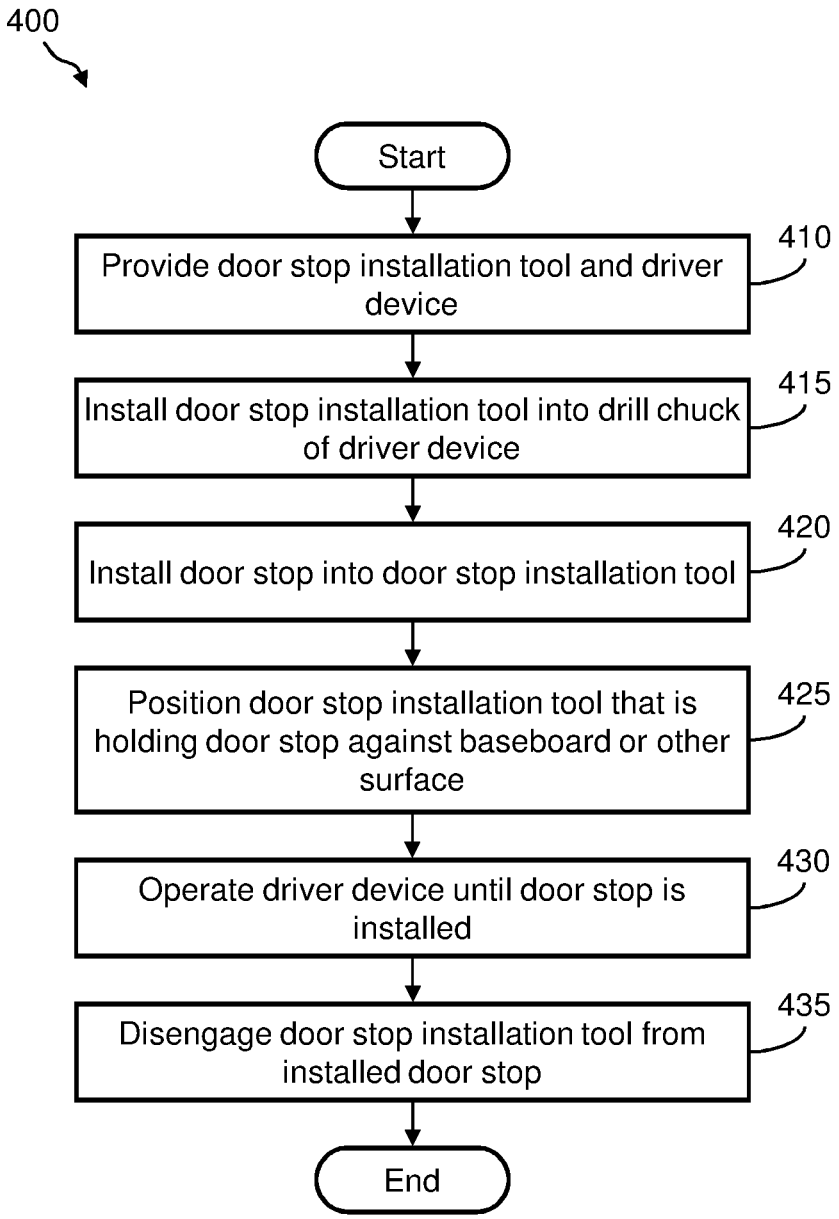

Having thus described the presently disclosed subject matter in general terms, reference will now be made to the accompanying drawings, which are not necessarily drawn to scale, and wherein:

FIG. 1 illustrates a perspective view of four examples of a door stop installation tool in accordance with embodiments of the invention;

FIG. 2 illustrates a perspective view of four examples of door stops that correspond respectively to the four examples of the door stop installation tools shown in FIG. 1;

FIG. 3 illustrates a perspective view of the four door stop installation tools shown in FIG. 1 and with each holding their corresponding door stop;

FIG. 4 illustrates a transparent perspective view of the four door stop installation tools shown in FIG. 1 and with each holding their corresponding door stop;

FIG. 5 illustrates a front view of an example of the door stop installation tool installed in a drill chuck in accordance with an embodiment of the invention;

FIG. 6 illustrates perspective views of a first example of the door stop installation tool, first absent the door stop and then holding the door stop in accordance with an embodiment of the invention;

FIG. 7 illustrates transparent perspective views of the first example of the door stop installation tool, first absent the door stop and then holding the door stop in accordance with an embodiment of the invention;

FIG. 8 illustrates an exploded view of the first example of the door stop installation tool in relation to its corresponding door stop in accordance with an embodiment of the invention;

FIG. 9 illustrates a cross-sectional view of the first example of the door stop installation tool holding its corresponding door stop in accordance with an embodiment of the invention;

FIG. 10 illustrates another transparent perspective view of the first example of the door stop installation tool holding its corresponding door stop in accordance with an embodiment of the invention;

FIG. 11 and FIG. 12 illustrate four different side views of the first example of the door stop installation tool in accordance with an embodiment of the invention;

FIG. 13 illustrates a top view and a bottom view of the first example of the door stop installation tool in accordance with an embodiment of the invention;

FIG. 14 illustrates various cross-sectional views of the first example of the door stop installation tool in accordance with an embodiment of the invention;

FIG. 15 illustrates a detailed drawing of the first example of the door stop installation tool in accordance with an embodiment of the invention;

FIG. 16 illustrates a perspective view of a second example of the door stop installation tool in accordance with an embodiment of the invention;

FIG. 17 and FIG. 18 illustrate transparent perspective views of the second example of the door stop installation tool in accordance with an embodiment of the invention;

FIG. 19 illustrates an exploded view of the second example of the door stop installation tool in accordance with an embodiment of the invention;

FIG. 20 illustrates side views of the second example of the door stop installation tool in accordance with an embodiment of the invention;

FIG. 21 illustrates a top view and a bottom view of the second example of the door stop installation tool in accordance with an embodiment of the invention;

FIG. 22 illustrates various cross-sectional views of the second example of the door stop installation tool in accordance with an embodiment of the invention;

FIG. 23 illustrates a detailed drawing of the second example of the door stop installation tool in accordance with an embodiment of the invention;

FIG. 24 illustrates perspective views of a third example of the door stop installation tool, third absent the door stop and then holding the door stop in accordance with an embodiment of the invention;

FIG. 25 illustrates transparent perspective views of the third example of the door stop installation tool, third absent the door stop and then holding the door stop in accordance with an embodiment of the invention;

FIG. 26 illustrates an exploded view of the third example of the door stop installation tool in relation to its corresponding door stop in accordance with an embodiment of the invention;

FIG. 27 illustrates a cross-sectional view of the third example of the door stop installation tool holding its corresponding door stop in accordance with an embodiment of the invention;

FIG. 28 illustrates another transparent perspective view of the third example of the door stop installation tool holding its corresponding door stop in accordance with an embodiment of the invention;

FIG. 29 and FIG. 30 illustrate four different side views of the third example of the door stop installation tool in accordance with an embodiment of the invention;

FIG. 31 illustrates a top view and a bottom view of the third example of the door stop installation tool in accordance with an embodiment of the invention;

FIG. 32 illustrates various cross-sectional views of the third example of the door stop installation tool in accordance with an embodiment of the invention;

FIG. 33 illustrates a detailed drawing of the third example of the door stop installation tool in accordance with an embodiment of the invention;

FIG. 34 illustrates perspective views of a fourth example of the door stop installation tool, fourth absent the door stop and then holding the door stop in accordance with an embodiment of the invention;

FIG. 35 illustrates transparent perspective views of the fourth example of the door stop installation tool, fourth absent the door stop and then holding the door stop in accordance with an embodiment of the invention;

FIG. 36 illustrates an exploded view of the fourth example of the door stop installation tool in relation to its corresponding door stop in accordance with an embodiment of the invention;

FIG. 37 illustrates a cross-sectional view of the fourth example of the door stop installation tool holding its corresponding door stop in accordance with an embodiment of the invention;

FIG. 38 illustrates another transparent perspective view of the fourth example of the door stop installation tool holding its corresponding door stop in accordance with an embodiment of the invention;

FIG. 39 and FIG. 40 illustrate four different side views of the fourth example of the door stop installation tool in accordance with an embodiment of the invention;

FIG. 41 illustrates a top view and a bottom view of the fourth example of the door stop installation tool in accordance with an embodiment of the invention;

FIG. 42 illustrates various cross-sectional views of the fourth example of the door stop installation tool in accordance with an embodiment of the invention;

FIG. 43 illustrates a detailed drawing of the fourth example of the door stop installation tool in accordance with an embodiment of the invention; and FIG. 44 illustrates a flow diagram of an example of a method of using the door stop installation tool in accordance with an embodiment of the invention.

DETAILED DESCRIPTION

The presently disclosed subject matter now will be described more fully hereinafter with reference to the accompanying drawings, in which some, but not all embodiments of the presently disclosed subject matter are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated Drawings. Therefore, it is to be understood that the presently disclosed subject matter is not to be limited to the specific embodiments disclosed and that modifications and other embodiments are intended to be included within the scope of the appended claims.

In some embodiments, the presently disclosed subject matter provides a door stop installation tool and method of using same. The presently disclosed door stop installation tool and method provide a means for easily installing a door stop (or doorstop or door stopper) under power rather than manually by hand.

In some embodiments, the presently disclosed door stop installation tool may include, for example, a driver bit body and a hex extension member that extends from one end of the driver bit body. Further, a door stop receiving portion is integrated into the driver bit body for holding a certain type, style, and/or brand of door stop. Via the hex extension member, the presently disclosed door stop installation tool may be installed into a drill chuck of a powered driver device, such as a drill or impact driver. The door stop receiving portion of the door stop installation tool allows the door stop to be easily installed therein and removed therefrom.

In some embodiments, the presently disclosed door stop installation tool and method allows users to quickly install door stops in tight spaces. Further, in a quick and easy process, an operator may install the presently disclosed door stop installation tool into a powered driver device, then slide a door stop into the door stop installation tool, then install under power the door stop on a baseboard or other surface, then disengage the door stop installation tool from the installed door stop, and then move onto the next without using hand tools.

Referring now to FIG. 1 through FIG. 44, four non-limiting examples of the presently disclosed door stop installation tool are provided. However, these are exemplary only. The presently disclosed door stop installation tool may be tailored for any type, style, and/or brand of door stop.

Referring now to FIG. 1 is a perspective view of four examples of the presently disclosed door stop installation tool. A first example of the presently disclosed door stop installation tool may be a door stop installation tool 100. Door stop installation tool 100 may include, for example, a driver bit body 102 that has a body proximal end 104 and a body distal end 106. Further, a door stop receiving portion 108 may be integrated into driver bit body 102 for holding a certain type, style, and/or brand of door stop. Further, a hex extension 110 extends from body proximal end 104 of driver bit body 102. Hex extension 110 may be a member for locking into a drill chuck (see FIG. 5). More details of door stop installation tool 100 are shown and described hereinbelow with reference to FIG. 6 through FIG. 15.

A second example of the presently disclosed door stop installation tool may be a door stop installation tool 120. Door stop installation tool 120 may include, for example, a driver bit body 122 that has a body proximal end 124 and a body distal end 126. Further, a door stop receiving portion 128 may be integrated into driver bit body 122 for holding a certain type, style, and/or brand of door stop. Further, a hex extension 130 extends from body proximal end 124 of driver bit body 122. Hex extension 130 may be a member for locking into a drill chuck (see FIG. 5). More details of door stop installation tool 120 are shown and described hereinbelow with reference to FIG. 16 through FIG. 23.

A third example of the presently disclosed door stop installation tool may be a door stop installation tool 140. Door stop installation tool 140 may include, for example, a driver bit body 142 that has a body proximal end 144 and a body distal end 146. Further, a door stop receiving portion 148 may be integrated into driver bit body 142 for holding a certain type, style, and/or brand of door stop. Further, a hex extension 150 extends from body proximal end 144 of driver bit body 142. Hex extension 150 may be a member for locking into a drill chuck (see FIG. 5). More details of door stop installation tool 140 are shown and described hereinbelow with reference to FIG. 24 through FIG. 33.

A fourth example of the presently disclosed door stop installation tool may be a door stop installation tool 160. Door stop installation tool 160 may include, for example, a driver bit body 162 that has a body proximal end 164 and a body distal end 166. Further, a door stop receiving portion 168 may be integrated into driver bit body 162 for holding a certain type, style, and/or brand of door stop. Further, a hex extension 170 extends from body proximal end 164 of driver bit body 162. Hex extension 170 may be a member for locking into a drill chuck (see FIG. 5). More details of door stop installation tool 160 are shown and described hereinbelow with reference to FIG. 34 through FIG. 43.

Referring now to FIG. 2 is a perspective view of four examples of door stops (or doorstops or door stoppers) that correspond respectively to the four examples of the door stop installation tools shown in FIG. 1. Namely, FIG. 2 shows a door stop 200, a door stop 220, a door stop 240, and a door stop 260.

Door stop installation tool 100 shown in FIG. 1 is designed for holding and installing door stop 200, which is an example of a certain type, style, and/or brand of door stop. In this example, door stop receiving portion 108 of driver bit body 102 of door stop installation tool 100 may be an opening that runs along driver bit body 102 and is open at distal end 106 of driver bit body 102. Further, door stop receiving portion 108 may be shaped to substantially correspond to the shape of door stop 200. Door stop 200 may include, for example, a shaft 202, a head end 204 (e.g., a rubber head), a screw end 206, and a grip feature 208. Grip feature 208 may be the portion door stop 200 that is grasped for turning door stop 200 during installation.

Door stop 220 is a two-piece coil spring type of door stop, which is another example of a certain type, style, and/or brand of door stop. For example, door stop 220 may include a coil spring body 222 and a detachable screw end 226. That is, during installation, coil spring body 222 may be separated from screw end 226. Then, screw end 226 is installed on the baseboard or surface. Then, coil spring body 222 may be reattached to screw end 226. Door stop installation tool 120 shown in FIG. 1 is designed for holding and installing screw end 226 of door stop 220. Accordingly, door stop receiving portion 128 of driver bit body 122 of door stop installation tool 120 may be an opening at distal end 126 of driver bit body 122 that is shaped to substantially correspond to the shape of screw end 226 of door stop 220.

Door stop installation tool 140 shown in FIG. 1 is designed for holding and installing door stop 240, which is another example of a certain type, style, and/or brand of door stop. In this example, door stop receiving portion 148 of driver bit body 142 of door stop installation tool 140 may be an opening that runs along driver bit body 142 and is open at distal end 146 of driver bit body 142. Further, door stop receiving portion 148 may be shaped to substantially correspond to the shape of door stop 240. Door stop 240 may include, for example, a shaft 242, a head end 244 (e.g., a rubber head), a screw end 246. Shaft 242 serves as the grip feature of door stop 240.

Door stop installation tool 160 shown in FIG. 1 is designed for holding and installing door stop 260, which is another example of a certain type, style, and/or brand of door stop. In this example, door stop receiving portion 168 of driver bit body 162 of door stop installation tool 160 may be an opening that runs along driver bit body 162 and is open at distal end 166 of driver bit body 102. Further, door stop receiving portion 168 may be shaped to substantially correspond to the shape of door stop 260. Door stop 260 may include, for example, a shaft 262, a head end 264 (e.g., a rubber head), a screw end 266, and a grip feature 268. Grip feature 268 may be the portion door stop 260 that is grasped for turning door stop 260 during installation.

Referring now to FIG. 3 is a perspective view of door stop installation tools 100, 120, 140, and 160 shown in FIG. 1 holding their corresponding door stop 200, screw end 226, door stop 240, and door stop 260, respectively.

Referring now to FIG. 4 is a transparent perspective view of door stop installation tools 100, 120, 140, and 160 shown in FIG. 1 holding their corresponding door stops 200, 240, and 260, respectively. In this view, door stop installation tool 120 is absent screw end 226.

Referring now to FIG. 5 is a front view of an example of the presently disclosed door stop installation tool installed in a drill chuck. In this example, hex extension 110 of door stop installation tool 100 may be locked into a drill chuck 300. Drill chuck 300 may be any standard drill chuck of any mechanism capable of imparting rotational motion to any of the presently disclosed door stop installation tools. For example, drill chuck 300 may be a standard drill chuck of any powered driver device, such as, but not limited to, a corded drill, a cordless drill, an impact driver, and the like.

In door stop installation tool 100, the inside profile of door stop receiving portion 108 of driver bit body 102 may include features for engaging with grip feature 208 of door stop 200 (see FIG. 9). In this way, any rotational motion imparted to door stop installation tool 100 may be transferred to door stop 200.

In door stop installation tool 120, door stop receiving portion 128 of driver bit body 122 may include features for engaging with screw end 226 of door stop 220. In this way, any rotational motion imparted to door stop installation tool 120 may be transferred to screw end 226.

In door stop installation tool 140, the inside profile of door stop receiving portion 148 of driver bit body 142 may include features for engaging with shaft 242 (i.e., the grip feature) of door stop 240 (see FIG. 27). In this way, any rotational motion imparted to door stop installation tool 140 may be transferred to door stop 240.

In door stop installation tool 160, the inside profile of door stop receiving portion 168 of driver bit body 162 may include features for engaging with grip feature 268 of door stop 260 (see FIG. 37). In this way, any rotational motion imparted to door stop installation tool 160 may be transferred to door stop 260.

Further, door stop installation tools 100, 120, 140, and 160 may include centering features to assist in keeping the door stop centered while turning. Centering features of door stop installation tools 100, 120, 140, and 160 may include, for example a concentric feature that nests the tip and or base of the door stop. This feature may also be an external ring that can constrain the door stop centered in the tool.

Referring now to FIG. 6 through FIG. 15 is more details of door stop installation tool 100, which is one example of the presently disclosed door stop installation tool. For example, FIG. 6 shows perspective views of door stop installation tool 100, first absent door stop 200 and then holding door stop 200. FIG. 7 shows transparent perspective views of door stop installation tool 100, first absent door stop 200 and then holding door stop 200. FIG. 8 shows an exploded view of door stop installation tool 100 in relation to door stop 200. FIG. 9 shows a cross-sectional view of door stop installation tool 100 holding door stop 200 taken along line A-A of FIG. 6. FIG. 10 shows another transparent perspective view of door stop installation tool 100 holding door stop 200. FIG. 11 and FIG. 12 show four different side views of door stop installation tool 100. FIG. 13 shows a top view and a bottom view of door stop installation tool 100.

FIG. 14 shows various cross-sectional views of door stop installation tool 100. For example, FIG. 14 shows a cross-sectional view of door stop installation tool 100 taken along line B-B of FIG. 11, a cross-sectional view of door stop installation tool 100 taken along line C-C of FIG. 11, and a cross-sectional view of door stop installation tool 100 taken along line D-D of FIG. 11.

FIG. 15 shows a detailed drawing of door stop installation tool 100 and showing example dimensions thereof. In one example, door stop installation tool 100 may have an overall length in the range of about 125 mm. Further, driver bit body 102 of door stop installation tool 100 may have a length in the range of about 100 mm and an outside diameter in the range of about 25 mm. Further, hex extension 110 of door stop installation tool 100 may have a length in the range of about 25 mm and a cross-sectional width in the range of about 6.35 mm. The above example dimensions of door stop installation tool 100 (overall length, bit driver body 102 length and outside diameter, hex extension 110 length and cross-sectional width), are non-limiting examples only, and may be less than or greater than the recited example values.

Referring now to FIG. 16 through FIG. 23 is more details of door stop installation tool 120, which is another example of the presently disclosed door stop installation tool. For example, FIG. 16 shows a perspective view of door stop installation tool 120. FIG. 17 and FIG. 18 show transparent perspective views of door stop installation tool 120. FIG. 19 shows an exploded view of door stop installation tool 120. This view shows that the distal end of hex extension 130 extends into door stop receiving portion 128 of driver bit body 122. Further, the distal end of hex extension 130 includes a Phillips head (cross-head) screwdriver tip 132 for engaging with a Phillips head screw of screw end 226 of door stop 220. Additionally, a pair of magnets 134 may be provided in door stop receiving portion 128 of driver bit body 122. Magnets 134 may be provided for holding screw end 226 of door stop 220 in door stop installation tool 120 when installing screw end 226. FIG. 20 shows side views of door stop installation tool 120. FIG. shows is a top view and a bottom view of door stop installation tool 120. FIG. 22 shows various cross-sectional views of door stop installation tool 120. For example, FIG. 22 shows a cross-sectional view of door stop installation tool 100 taken along line A-A of FIG. 20 and a cross-sectional view of door stop installation tool 100 taken along line B-B of FIG. 20.

FIG. 23 shows a detailed drawing of door stop installation tool 120 and showing example dimensions thereof. In one example, door stop installation tool 120 may have an overall length in the range of about 125 mm. Further, driver bit body 122 of door stop installation tool 120 may have a length in the range of about 100 mm and an outside diameter in the range of about 32 mm. Further, hex extension 130 of door stop installation tool 120 may have a length in the range of about 25 mm and a cross-sectional width in the range of about 6.35 mm. The above example dimensions of door stop installation tool 120 (overall length, bit driver body 122 length and outside diameter, hex extension 130 length and cross-sectional width), are non-limiting examples only, and may be less than or greater than the recited example values.

Referring now to FIG. 24 through FIG. 33 is more details of door stop installation tool 140, which is another example of the presently disclosed door stop installation tool. For example, FIG. 24 shows perspective views of door stop installation tool 140, first absent door stop 240 and then holding door stop 240. FIG. 25 shows transparent perspective views of door stop installation tool 140, first absent door stop 240 and then holding door stop 240. FIG. 26 shows an exploded view of door stop installation tool 140 in relation to door stop 240. FIG. 27 shows a cross-sectional view of door stop installation tool 140 holding door stop 240 taken along line A-A of FIG. 24. FIG. 28 shows another transparent perspective view of door stop installation tool 140 holding door stop 240. FIG. 29 and FIG. 30 show four different side views of door stop installation tool 140. FIG. 31 shows a top view and a bottom view of door stop installation tool 140.

FIG. 32 shows various cross-sectional views of door stop installation tool 140. For example, FIG. 32 shows a cross-sectional view of door stop installation tool 140 taken along line B-B of FIG. 29, a cross-sectional view of door stop installation tool 140 taken along line C-C of FIG. 29, and a cross-sectional view of door stop installation tool 140 taken along line D-D of FIG. 29.

FIG. 33 shows a detailed drawing of door stop installation tool 140 and showing example dimensions thereof. In one example, door stop installation tool 140 may have an overall length in the range of about 125 mm. Further, driver bit body 142 of door stop installation tool 140 may have a length in the range of about 100 mm and an outside diameter in the range of about 29 mm. Further, hex extension 150 of door stop installation tool 140 may have a length in the range of about 25 mm and a cross-sectional width in the range of about 6.35 mm. The above example dimensions of door stop installation tool 140 (overall length, bit driver body 142 length and outside diameter, hex extension 150 length and cross-sectional width), are non-limiting examples only, and may be less than or greater than the recited example values.

Referring now to FIG. 34 through FIG. 43 is more details of door stop installation tool 160, which is another example of the presently disclosed door stop installation tool. For example, FIG. 34 shows perspective views of door stop installation tool 160, first absent door stop 260 and then holding door stop 260. FIG. 35 shows transparent perspective views of door stop installation tool 160, first absent door stop 260 and then holding door stop 260. FIG. 36 shows an exploded view of door stop installation tool 160 in relation to door stop 260. FIG. 37 shows a cross-sectional view of door stop installation tool 160 holding door stop 260 taken along line A-A of FIG. 34. FIG. 38 shows another transparent perspective view of door stop installation tool 160 holding door stop 260. FIG. 39 and FIG. 40 show four different side views of door stop installation tool 160. FIG. 41 shows a top view and a bottom view of door stop installation tool 160.

FIG. 42 shows various cross-sectional views of door stop installation tool 160. For example, FIG. 42 shows a cross-sectional view of door stop installation tool 160 taken along line B-B of FIG. 39, a cross-sectional view of door stop installation tool 160 taken along line C-C of FIG. 39, and a cross-sectional view of door stop installation tool 160 taken along line D-D of FIG. 39.

FIG. 43 shows a detailed drawing of door stop installation tool 160 and showing example dimensions thereof. In one example, door stop installation tool 160 may have an overall length in the range of about 125 mm. Further, driver bit body 162 of door stop installation tool 160 may have a length in the range of about 100 mm and an outside diameter in the range of about 25 mm. Further, hex extension 170 of door stop installation tool 160 may have a length in the range of about 25 mm and a cross-sectional width in the range of about 6.35. The above example dimensions of door stop installation tool 160 (overall length, bit driver body 162 length and outside diameter, hex extension 170 length and cross-sectional width), are non-limiting examples only, and may be less than or greater than the recited example values.

Referring now to FIG. 44 is a flow diagram of an example of a method 400 of using the presently disclosed door stop installation tool. Method 400 provides a quick and easy process wherein an operator may slide a door stop into the presently disclosed door stop installation tool, then install the door stop on a baseboard or other surface, then disengage the door stop installation tool from the installed door stop, and then move onto the next without using hand tools. Method 400 may include, but is not limited to, the following steps.

At a step 410, the presently disclosed door stop installation tool and a driver device is provided. For example, door stop installation tool 100, 120, 140, and/or 160 is provided along with any type of powered driver device, such as, but not limited to, any corded drill, cordless drill, impact driver, and the like.

At a step 415, the door stop installation tool is installed into the drill chuck of the driver device. For example, hex extension 110 of door stop installation tool 100, hex extension 130 of door stop installation tool 120, hex extension 150 of door stop installation tool 140, or hex extension 170 of door stop installation tool 160 is installed into drill chuck 300 (see FIG. 5) of the driver device.

At a step 420, the door stop is installed into the door stop installation tool. For example, door stop 200 is installed into door stop receiving portion 108 of door stop installation tool 100, screw end 226 of door stop 220 is installed into door stop receiving portion 128 of door stop installation tool 120, door stop 240 is installed into door stop receiving portion 148 of door stop installation tool 140, or door stop 260 is installed into door stop receiving portion 168 of door stop installation tool 160.

At a step 425, the door stop installation tool that is holding door stop is positioned against the baseboard or other surface. For example, door stop installation tool 100 that is holding door stop 200 is positioned against the baseboard or other surface, door stop installation tool 120 that is holding screw end 226 of door stop 220 is positioned against the baseboard or other surface, door stop installation tool 140 that is holding door stop 240 is positioned against the baseboard or other surface, or door stop installation tool 160 that is holding door stop 260 is positioned against the baseboard or other surface.

At a step 430, the driver device is operated until the door stop is installed. For example, the driver device of door stop installation tool 100 is operated until door stop 200 is installed, the driver device of door stop installation tool 120 is operated until screw end 226 of door stop 220 is installed, the driver device of door stop installation tool 140 is operated until door stop 240 is installed, or the driver device of door stop installation tool 160 is operated until door stop 260 is installed.

At a step 435, the door stop installation tool is disengage from the installed door stop. For example, for door stop installation tool 100, 140, and 160, the driver device is pulled back and to the side to release the installed door stop 200, 240, or 260. For door stop installation tool 120, the driver device is pulled back to release the installed screw end 226 of door stop 220.

Referring now again to FIG. 1 through FIG. 44, the presently disclosed door stop installation tool (e.g., door stop installation tools 100, 120, 140, and 160) and method 400 provide a means for installing a door stop under power rather than manually by hand. Further, the presently disclosed door stop installation tool is not limited to the example door stop installation tools 100, 120, 140, and 160. These are exemplary only. The presently disclosed door stop installation tool may be tailored for any type, style, and/or brand of door stop. The example dimension values provided herein of the door stop installation tool (e.g., door stop installation tools 100, 120, 140, and 160), are non-limiting examples only, and may be less than or greater than the recited example values.

Referring still again to FIG. 1 through FIG. 44, the presently disclosed door stop installation tool (e.g., door stop installation tools 100, 120, 140, and 160) and method 400 allow users to quickly install door stops in tight spaces. Further, in a quick and easy process, as described in method 400, an operator may install the presently disclosed door stop installation tool into a powered driver device, then slide a door stop into the door stop installation tool, then install the door stop on a baseboard or other surface, then disengage the door stop installation tool from the installed door stop, and then move onto the next without using hand tools.

Following long-standing patent law convention, the terms "a," "an," and "the" refer to "one or more" when used in this application, including the claims. Thus, for example, reference to "a subject" includes a plurality of subjects, unless the context clearly is to the contrary (e.g., a plurality of subjects), and so forth.

Throughout this specification and the claims, the terms "comprise," "comprises," and "comprising" are used in a non-exclusive sense, except where the context requires otherwise. Likewise, the term "include" and its grammatical variants are intended to be non-limiting, such that recitation of items in a list is not to the exclusion of other like items that can be substituted or added to the listed items.

For the purposes of this specification and appended claims, unless otherwise indicated, all numbers expressing amounts, sizes, dimensions, proportions, shapes, formulations, parameters, percentages, quantities, characteristics, and other numerical values used in the specification and claims, are to be understood as being modified in all instances by the term "about" even though the term "about" may not expressly appear with the value, amount or range. Accordingly, unless indicated to the contrary, the numerical parameters set forth in the following specification and attached claims are not and need not be exact, but may be approximate and/or larger or smaller as desired, reflecting tolerances, conversion factors, rounding off, measurement error and the like, and other factors known to those of skill in the art depending on the desired properties sought to be obtained by the presently disclosed subject matter. For example, the term "about," when referring to a value can be meant to encompass variations of, in some embodiments ±100%, in some embodiments ±50%, in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed methods or employ the disclosed compositions.

Further, the term "about" when used in connection with one or more numbers or numerical ranges, should be understood to refer to all such numbers, including all numbers in a range and modifies that range by extending the boundaries above and below the numerical values set forth. The recitation of numerical ranges by endpoints includes all numbers, e.g., whole integers, including fractions thereof, subsumed within that range (for example, the recitation of 1 to 5 includes 1, 2, 3, 4, and 5, as well as fractions thereof, e.g., 1.5, 2.25, 3.75, 4.1, and the like) and any range within that range.

Although the foregoing subject matter has been described in some detail by way of illustration and example for purposes of clarity of understanding, it will be understood by those skilled in the art that certain changes and modifications can be practiced within the scope of the appended claims.

That which is claimed:

1. A door stop installation device, comprising:

a. a main body portion;

b. a door stop receiving portion integrated into the main body portion, wherein the door stop receiving portion is configured to receive a door stop therein, and wherein the door stop receiving portion comprises a door stop gripping portion defined by a first side wall, a second side wall opposing the first side wall and parallel thereto, and a third side wall spaced between the first and second side walls and perpendicular thereto, wherein the door stop gripping portion is configured to engage with a grip feature of the door stop;

c. an extension portion extending from a proximal end of the main body portion; and an opening in a distal end of the main body portion.

2. The device of claim 1, wherein the door stop receiving portion comprises a cavity formed in the main body portion.

3. The device of claim 1, wherein a proximal end of the extension portion is configured to engage with a driver device.

4. The device of claim 1, wherein the extension portion comprises a hex extension.

5. The device of claim 1, wherein the main body portion and extension portion are configured together such that as the extension portion rotates the main body portion rotates.

6. The device of claim 5, wherein the door stop receiving portion of the main body portion is configured such that as the main body portion rotates a door stop received in the door stop receiving portion rotates.

7. The device of claim 1, wherein a distal end of the extension portion extends into the door stop receiving portion.

8. The device of claim 7, wherein the distal end of the extension portion comprises one of a slotted, cross-head, torx, or hex head.

9. The device of claim 1, wherein the main body portion further comprises one or magnets at the distal end of the main body portion.

10. The device of claim 1, wherein the main body portion comprises a slot formed in a side thereof for inserting a door stop into the door stop receiving portion.

11. The device of claim 1, wherein the door stop receiving portion is configured such that when a door stop is received therein a portion of the door stop extends through the opening and beyond the distal end of the main body portion.

12. A method of installing a door stop, the method comprising:

a. providing a door stop installation device, the door stop installation device comprising:

i. a main body portion;

ii. a door stop receiving portion integrated into the main body portion, wherein the door stop receiving portion is configured to receive a door stop therein, and wherein the door stop receiving portion comprises a door stop gripping portion defined by a first side wall, a second side wall opposing the first side wall and parallel thereto, and a third side wall spaced between the first and second side walls and perpendicular thereto, wherein the door stop gripping portion is configured to engage with a grip feature of the door stop;

iii. an extension portion extending from a proximal end of the main body portion; and iv. an opening in a distal end of the main body portion;

b. installing the door stop into the door stop receiving portion of the door stop installation device, such that the door stop gripping portion is engaged with a grip feature of the door stop;

c. installing the door stop into the designated structure via a driver device; and d. disengaging the door stop installation device from the installed door stop.

* * * * *